US010253724B2

(12) United States Patent
Tour et al.

(10) Patent No.: US 10,253,724 B2
(45) Date of Patent: Apr. 9, 2019

(54) VARIABLE VOLUME TRANSFER SHUTTLE CAPSULE AND VALVE MECHANISM

(71) Applicant: Tour Engine, Inc., San Diego, CA (US)

(72) Inventors: Hugo Benjamin Tour, Rehovot (IL); Oded Tour, San Diego, CA (US); Gilad Tour, Rehovot (IL); Ehud Sivan, Lehavim (IL); Michael H. Wahl, Bonita, CA (US)

(73) Assignee: Tour Engine, Inc., San Diego, CA (US)

( * ) Notice: Subject to any disclaimer, the term of this patent is extended or adjusted under 35 U.S.C. 154(b) by 83 days.

(21) Appl. No.: 15/113,033

(22) PCT Filed: Jan. 16, 2015

(86) PCT No.: PCT/US2015/011856

§ 371 (c)(1),
(2) Date: Jul. 20, 2016

(87) PCT Pub. No.: WO2015/109256

PCT Pub. Date: Jul. 23, 2015

(65) Prior Publication Data

US 2017/0009701 A1 Jan. 12, 2017

Related U.S. Application Data

(60) Provisional application No. 61/929,143, filed on Jan. 20, 2014.

(51) Int. Cl.
*F01L 5/04* (2006.01)
*F01L 5/06* (2006.01)
(Continued)

(52) U.S. Cl.
CPC ..... *F02G 1/055* (2013.01); *F01L 5/04* (2013.01); *F01L 5/06* (2013.01); *F01L 7/02* (2013.01);
(Continued)

(58) Field of Classification Search
CPC ..... F02G 2242/30; F02G 2242/32; F02G 2243/30–2243/40; F02G 2270/90
(Continued)

(56) References Cited

U.S. PATENT DOCUMENTS 1,372,216 A 3/1921 Casaday
1,374,140 A 4/1921 Dock
(Continued)

FOREIGN PATENT DOCUMENTS

CN 102777253 11/2012
FR 1 084 655 1/1955
(Continued)

OTHER PUBLICATIONS

European Search Report for EP 15736989.3, dated Sep. 13, 2017, 6 pages.
(Continued)

*Primary Examiner* — Laert Dounis
(74) *Attorney, Agent, or Firm* — Morrison & Foerster LLP

(57) ABSTRACT

An engine includes a compression chamber that intakes and compresses working fluid; an expansion chamber that expands and exhausts working fluid; and a transfer chamber that receives working fluid from the compression chamber and transfers working fluid to the expansion chamber, wherein an internal volume of the transfer chamber decreases during the transfer of working fluid.

20 Claims, 19 Drawing Sheets

(51) Int. Cl.

| | |
|---|---|
| ***F02G 1/02*** | (2006.01) |
| ***F02G 1/043*** | (2006.01) |
| ***F02G 1/055*** | (2006.01) |
| ***F01L 7/02*** | (2006.01) |
| *F01N 5/02* | (2006.01) |

(52) U.S. Cl.
CPC ..... *F01L 7/022* (2013.01); *F02G 1/02* (2013.01); *F02G 1/043* (2013.01); *F01N 5/02* (2013.01); *F02G 2244/00* (2013.01); *F02G 2244/08* (2013.01); *F02G 2270/55* (2013.01)

(58) Field of Classification Search
USPC ..... 60/516–526
See application file for complete search history.

(56) References Cited

U.S. PATENT DOCUMENTS

| | | | | | |
|---|---|---|---|---|---|
| 2,302,442 | A | | 11/1942 | Hickey | |
| 2,522,649 | A | | 10/1945 | Tenney | |
| 2,404,395 | A | * | 7/1946 | Milliken | F02G 3/02 123/193.4 |
| 2,657,553 | A | * | 11/1953 | Jonkers | F02G 1/043 60/525 |
| 3,145,527 | A | * | 8/1964 | Morgenroth | F02G 1/043 60/522 |
| 3,522,797 | A | | 8/1970 | Stinebaugh | |
| 3,880,126 | A | | 4/1975 | Thurston et al. | |
| 4,199,945 | A | * | 4/1980 | Finkelstein | F02G 1/0435 60/520 |
| 4,202,300 | A | | 5/1980 | Skay | |
| 4,630,447 | A | * | 12/1986 | Webber | F02B 41/06 60/516 |
| 4,663,938 | A | | 5/1987 | Colgate | |
| 4,794,752 | A | * | 1/1989 | Redderson | F02G 1/044 60/517 |
| 5,040,498 | A | | 8/1991 | Scherer | |
| 5,345,765 | A | | 9/1994 | Kinnersly | |
| 5,546,897 | A | | 8/1996 | Brackett | |
| 5,551,382 | A | | 9/1996 | Bauer | |
| 6,205,788 | B1 | | 3/2001 | Warren | |
| 6,487,858 | B2 | | 12/2002 | Cammack | |
| 6,880,501 | B2 | | 4/2005 | Suh et al. | |
| 7,050,900 | B2 | | 5/2006 | Miller | |
| 7,177,751 | B2 | | 2/2007 | Froloff | |
| 7,178,324 | B2 | | 2/2007 | Sakita | |
| 7,263,963 | B2 | | 9/2007 | Price | |
| 7,806,101 | B2 | | 10/2010 | Hu | |
| 8,006,656 | B2 | | 8/2011 | Branyon | |
| 8,082,892 | B2 | | 12/2011 | Zhao | |
| 8,210,138 | B2 | | 7/2012 | Scuderi | |
| 8,210,147 | B2 | | 7/2012 | Cotton | |
| 8,371,256 | B2 | | 2/2013 | Durrett et al. | |
| 8,459,227 | B2 | | 6/2013 | Cotton | |
| 8,590,497 | B2 | | 11/2013 | Meldolesi | |
| 8,714,121 | B2 | | 5/2014 | Philips | |
| 8,904,981 | B2 | | 12/2014 | Fiveland | |
| 2003/0015171 | A1 | | 1/2003 | Scuderi | |
| 2009/0056670 | A1 | | 3/2009 | Zhao et al. | |
| 2009/0150060 | A1 | | 6/2009 | Branyon | |
| 2009/0199829 | A1 | | 8/2009 | Branyon et al. | |
| 2009/0250046 | A1 | | 10/2009 | Scuderi | |
| 2010/0012071 | A1 | | 1/2010 | Cotton | |
| 2010/0186689 | A1 | | 7/2010 | Tour et al. | |
| 2011/0149034 | A1 | | 6/2011 | Tsukagoshi | |
| 2012/0080017 | A1 | | 4/2012 | Philips | |
| 2012/0192841 | A1 | | 8/2012 | Medolesi | |
| 2012/0255296 | A1 | | 10/2012 | Philips | |
| 2012/0298086 | A1 | | 11/2012 | Scuderi | |
| 2016/0040623 | A1 | * | 2/2016 | Spiesberger | F02G 1/043 60/517 |

FOREIGN PATENT DOCUMENTS

| | | | | | |
|---|---|---|---|---|---|
| FR | 2 963 644 | | | 2/2012 | |
| FR | 2963644 | A1 | * | 2/2012 | F01K 25/00 |
| GB | 135 571 | | | 11/1918 | |
| GB | 2135423 | A | * | 8/1984 | F02G 1/043 |
| GB | 2 469 939 | | | 11/2010 | |
| JP | 06173763 | A | * | 6/1994 | F02G 1/043 |
| WO | WO-2011/115868 | | | 9/2011 | |
| WO | WO-2015177035 | A1 | * | 11/2015 | F02G 1/043 |

OTHER PUBLICATIONS

First Office Action (translation) for CN 201480050777.7, dated Sep. 27, 2017, 4 pages.
International Preliminary Report on Patentability for PCT/US14/47076, dated Jan. 19, 2016, 4 pages.
International Search Report and Written Opinion for PCT/US14/47076, dated Nov. 25, 2014, 5 pages.
International Search Report and Written Opinion for PCT/US2015/011856, dated May 11, 2015, 7 pages.
Supplementary European Search Report for EP 14825949.2, dated Feb. 17, 2017, 5 pages.
Notice of Reasons for Rejection (translation) for JP 2016-565121, dated May 16, 2018, 8 pages.

* cited by examiner

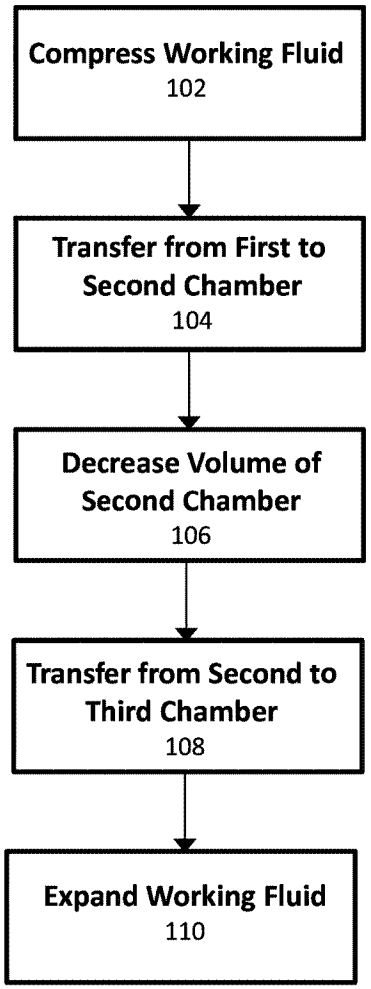
Figure 18
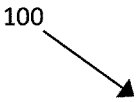

VARIABLE VOLUME TRANSFER SHUTTLE CAPSULE AND VALVE MECHANISM

CROSS-REFERENCE TO RELATED APPLICATIONS

This application is a U.S. National Stage application of International Application No. PCT/US2015/011856, filed Jan. 16, 2015, which claims the benefit of U.S. Provisional Application No. 61/929,143, filed Jan. 20, 2014, the contents of which are incorporated herein by reference in their entireties

BACKGROUND

Field

This disclosure relates to split-cycle engines incorporating numerous refinements and design features that may generally enhance engine performance. Particularly, this disclosure may increase split-cycle engine compression ratio. It may also raise working fluid temperature differentiation by providing cooler working fluid during the compression stroke, and hotter working fluid during the expansion stroke. Those improvements may be achieved by reducing dead volume usually residing within the various components of a split-cycle engine and connecting tube which serves as fluid connection passage between the compression cylinder (cold) outlet and the expansion cylinder (hot) inlet. Reduced dead volume may enable utilizing higher compression ratios which, in turn, leads to higher power density output and improved efficiency. Having a higher compressed working fluid enables a more efficient heat transfer in an external combustion engine (EC engine).

Description of Related Art

An EC engine (such as a Stirling engine, for example) uses temperature-difference between its hot cylinder and its cold cylinder to establish a close-cycle of a fixed mass of working fluid, which is heated and expanded, and cooled and compressed, thus converting thermal energy into mechanical energy. The greater the temperature-difference between the hot and cold states of the working fluid, the greater the thermal efficiency. The maximum theoretical efficiency is derived from the Carnot cycle; however the efficiency of a real engine is less than this value due to various losses.

A Stirling engine compared to steam engines and internal combustion engines is noted for its potential high efficiency, its quiet operation, and the ability to use almost any heat source or fuel for its operation. This compatibility with alternative and renewable energy sources has become increasingly significant as the price of fossil fuels rises, and also in light of concerns such as climate change and limited oil resources.

A Stirling engine (with and without a regenerator) has a connecting pipe between the cold and hot cylinders. The volume of this pipe, often regarded as "dead volume," causes a major efficiency loss. Consider an ideal Stirling engine connected to a dead volume via piping. During the high pressure part of the cycle, hot air from the engine mixes with colder air in the dead volume, which leads to a loss in efficiency. This is also true during the low pressure part of the cycle, as warm air mixes with the cooler air at the part of the engine where compression takes place. The same would apply to any other dead volume, such as dead volume within the displacer chamber. To clarify, mixing colder and warmer air together increases entropy but decreases exergy.

To address these problems, a regenerator (or economizer as Robert Stirling called it), was developed to increase the efficiency of Stirling engines. The design was originally a mass of steel wire located in the annulus that absorbed excess energy as the working fluid passed through it. A regenerator is essentially a pre-cooler, reducing the thermal load on the main cooler, as well as a pre-heater, reducing the energy required by the main heater to heat the working fluid.

SUMMARY

Disclosed herein are different and effective mechanisms to govern the transfer of working fluid in a timely manner and reduce pressure energy losses from the cold chamber to the hot chamber of a split-cycle engine. This may be achieved using a transfer shuttle capsule and valve system that may be durable with high level of sealing. The systems and methods described herein may separate the cold and hot cylinders with minimal "dead volume" between them, hence increasing the effective engine compression ratio and efficiency.

In view of the disadvantages inherent in the known types of external heat engines, embodiments disclosed herein include a Transfer Shuttle Capsule and Valve Mechanism (TSCVM) as part of an external heat engine (it could be also part of an internal combustion engine), which provides a more efficient utilization of temperature differentiated cylinders than conventional external heat engines (for example, various Stirling engine configurations). Some embodiments utilize a novel TSCVM for facilitating the efficient and reliable transfer of working fluid from the cold chamber to the hot chamber with minimal "dead volume" between them.

In an exemplary embodiment, a TSCVM external heat engine includes one cylinder coupled to a second cylinder, one piston positioned within the first cylinder and configured to perform intake and compression strokes, and a second piston positioned within the second cylinder and configured to perform expansion and exhaust strokes. The first cylinder, denoted cold (compression) cylinder, and the second cylinder, denoted hot (expansion) cylinder, can be considered as two separate chambers, that could be directly or indirectly coupled by the reciprocating motion of the TSCVM wherein, the first (cold) chamber resides in the cold cylinder, the second (hot) chamber resides in the hot cylinder. A third (transfer) chamber resides within the TSCVM and by coupling, first to the cold chamber and then to the hot chamber, transfers the working fluid from one to the other.

In an exemplary embodiment, heating or cooling of the transfer chamber can be applied to gain additional efficiency.

In a further exemplary embodiment, a fourth (reservoir) chamber serves to cool the working fluid before being drawn into the cold cylinder during the intake stroke. The hot cylinder expels hot working fluid into this fourth (reservoir) chamber during the exhaust stroke. A three way valve couples and decouples the cold chamber and the reservoir chamber. In a further exemplary embodiment, the same three way valve also couples and decouples the second hot chamber that is within the hot cylinder and the reservoir chamber.

In a further exemplary embodiment, the engine includes two piston connecting rods, and a crankshaft, which is used to actuate two pistons within two cylinders. The two connecting rods connect respective pistons to the crankshaft. The crankshaft converts rotational motion into reciprocating motion of the compression piston. The compression crankshaft throw relative angle, with regard to the expansion crankshaft throw, may differ from each other hence implementing a phase-angle-delay (phase-lag), such that the piston of the compression cylinder moves in advance of the piston of the expansion cylinder. In some embodiments the phase-lag could be as such that the piston of the expansion cylinder moves in advance of the piston of the compression cylinder. The two pistons and two cylinders could be designed in-line with each other (parallel) or opposed to each other. In one such embodiment with an in-line configuration of the two pistons and two cylinders, an insulating layer of low heat conducting material could be installed, for example, to separate the relatively cold first chamber from the relatively hot second chamber, as is commonly known in the art.

In some exemplary embodiments, the TSCVM may be constructed of several components: a capsule (spool) cylinder, a capsule shuttle, which is located within the capsule cylinder, a transfer chamber port, a capsule connecting rod and a capsule crankshaft. The compression cylinder may have an output port and the expansion cylinder may have an inlet port. The transfer chamber may be coupled to or decoupled from the compression cylinder output port and from the expansion cylinder inlet port depending on the relative momentary position of the shuttle capsule referenced to the capsule cylinder as a result of the capsule reciprocating motion.

In another embodiment, an engine includes a compression chamber that intakes and compresses working fluid; an expansion chamber that expands and exhausts working fluid; and a transfer chamber that receives working fluid from the compression chamber and transfers working fluid to the expansion chamber, wherein an internal volume of the transfer chamber decreases during the transfer of working fluid.

Decreasing the internal volume of the transfer chamber during transfer of the working fluid may advantageously increase the efficiency of the engine. For example, the decreasing volume may further increase the pressure of the working fluid prior to transfer, thus increasing the compression ratio of the engine. The engine may be an external split-cycle engine, and internal split-cycle engine, or any engine.

In a further embodiment, the working fluid is further compressed in the internal volume of the transfer chamber.

In a further embodiment, the engine includes a heat exchanger, for transfer of thermal energy from an external heat source to working fluid.

In a further embodiment, the engine includes a conduit that routes working fluid from the expansion chamber to the compression chamber. In a further embodiment, the engine includes a cooling chamber in the conduit. In a further embodiment, the engine includes a valve in the conduit that fluidly couples and decouples the compression and expansion chambers.

In a further embodiment, the engine includes an ignition source, inside the engine, that initiates expansion.

In a further embodiment, the engine includes a transfer port of the transfer chamber that alternatively fluidly couples to an outlet port of the compression chamber and to an inlet port of the expansion chamber. In yet a further embodiment, the transfer port simultaneously couples the outlet port of the compression chamber with the transfer port of the transfer chamber and the inlet port of the expansion chamber with the transfer port of the transfer chamber during a portion of a cycle of the engine.

In a further embodiment the transfer chamber comprises a transfer cylinder, a transfer cylinder extrusion, and a transfer cylinder housing, wherein the transfer cylinder is positioned within and moves relative to the transfer cylinder housing, and wherein the transfer cylinder extrusion is positioned within the transfer cylinder and does not move relative to the transfer cylinder housing. In a yet further embodiment, the extrusion is parabolic. In a yet further embodiment, the engine includes sealing rings between the transfer cylinder and transfer cylinder housing and between the transfer cylinder and transfer cylinder extrusion.

In another embodiment, a method of operating an engine includes: compressing working fluid in a first chamber; transferring working fluid from the first chamber to a second chamber; decreasing an internal volume of the second chamber while working fluid is within the internal volume; transferring working fluid from the second chamber to a third chamber; and expanding working fluid in the third chamber.

Decreasing the internal volume of the transfer chamber during transfer of the working fluid may advantageously increase the efficiency of the engine. For example, the decreasing volume may further increase the pressure of the working fluid prior to transfer, thus increasing the compression ratio of the engine. The engine may be an external split-cycle engine, and internal split-cycle engine, or any engine.

In a further embodiment, the method includes further compressing working fluid in the internal volume of the transfer chamber. In a further embodiment, the method includes transferring heat to the working fluid in the third chamber using a heat exchanger located partially outside the engine. In a yet further embodiment, the method includes routing working fluid from the third chamber to the first chamber. In a yet further embodiment, the method includes cooling working fluid as it is routed from the third chamber to the first chamber.

In a further embodiment, the method includes expanding working fluid in the third chamber.

In a further embodiment, the method includes alternatively fluidly coupling the second chamber to an outlet port of the first chamber and to an inlet port of the third chamber. In yet a further embodiment, the method includes simultaneously fluidly coupling the second chamber with the outlet port of the first chamber and the inlet port of the third chamber during a portion of a cycle of the engine.

In a further embodiment, the second chamber comprises a cylinder, a cylinder extrusion, and a cylinder housing, wherein the cylinder is positioned within and moves relative to the cylinder housing, and wherein the cylinder extrusion is positioned within the cylinder and does not move relative to the cylinder housing. In a further embodiment, the extrusion is parabolic. In a further embodiment the engine includes sealing rings between the cylinder and the cylinder housing and between the transfer cylinder and transfer cylinder extrusion.

In another embodiment, an engine includes: a compression chamber that intakes and compresses working fluid; an expansion chamber that expands and exhausts working fluid; a transfer chamber that receives working fluid from the compression chamber and transfers working fluid to the expansion chamber, wherein an internal volume of the transfer chamber decreases during the transfer of working fluid; and a heat exchanger, for transfer of thermal energy from an external heat source to working fluid.

Decreasing the internal volume of the transfer chamber during transfer of the working fluid may advantageously increase the efficiency of the engine. For example, the decreasing volume may further increase the pressure of the working fluid prior to transfer, thus increasing the compression ratio of the engine. The engine may be an external split-cycle engine, and internal split-cycle engine, or any engine.

In another embodiment the same mechanism as disclosed here as an external heat engine may have beneficiary use as Stirling cycle based refrigerator or Stirling cycle base heat-pump. Those two machine cycles are identical to an external heat engine cycle except that the heat absorbing end of the machine i.e. the expansion cylinder now becomes the cold chamber and the compression cylinder now becomes the machine hot chamber.

Further, although certain embodiments are described exclusively with respect to one or both of an external split-cycle combustion engine or an internal split-cycle combustion engine, it should be appreciated that the systems and methods apply equally to external split-cycle combustion engines, internal split-cycle combustion engines, and any other engine.

BRIEF DESCRIPTION OF THE DRAWINGS

FIG. 18 illustrates a method of operating an engine, in accordance with exemplary embodiments.

DETAILED DESCRIPTION OF EXEMPLARY EMBODIMENTS

The invention is described in detail below with reference to the figures, wherein similar elements are referenced with similar numerals throughout. It is understood that the figures are not necessarily drawn to scale. Nor do they necessarily show all the details of the various exemplary embodiments illustrated. Rather, they merely show certain features and elements to provide an enabling description of the exemplary embodiments.

Figure 1:
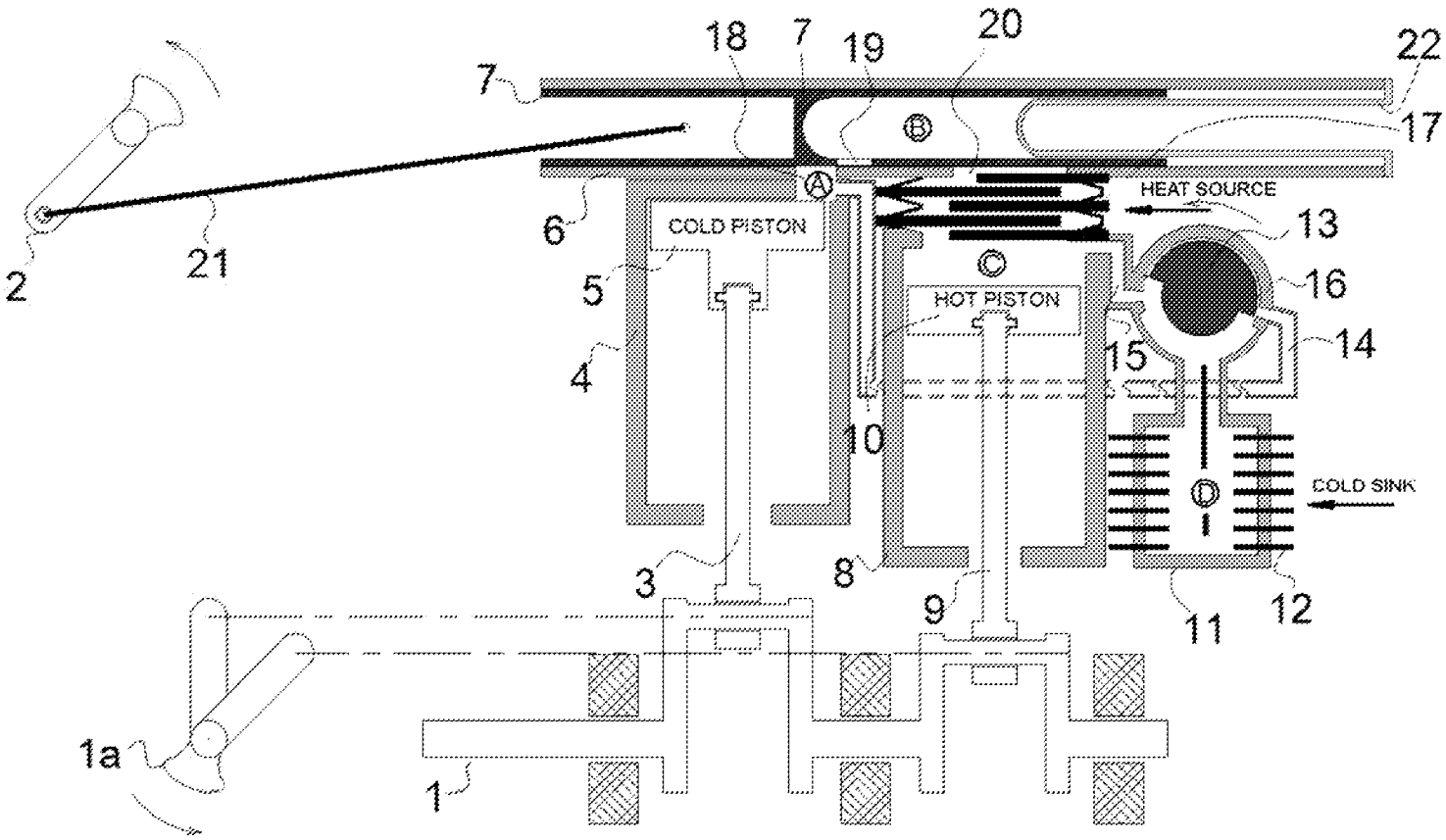
FIG. 1 is a simplified cross-sectional view of an in-line TSCVM external heat apparatus, in accordance with exemplary embodiments, wherein the compression crankshaft throw angle is illustrated where the compression piston reaches its Top Dead Center (TDC) and the expansion crankshaft throw angle is illustrated at 45 degrees before the expansion piston reaches its TDC. The TSCVM crankshaft is 45 degrees after its extreme left position (BDC).
Figure 2:
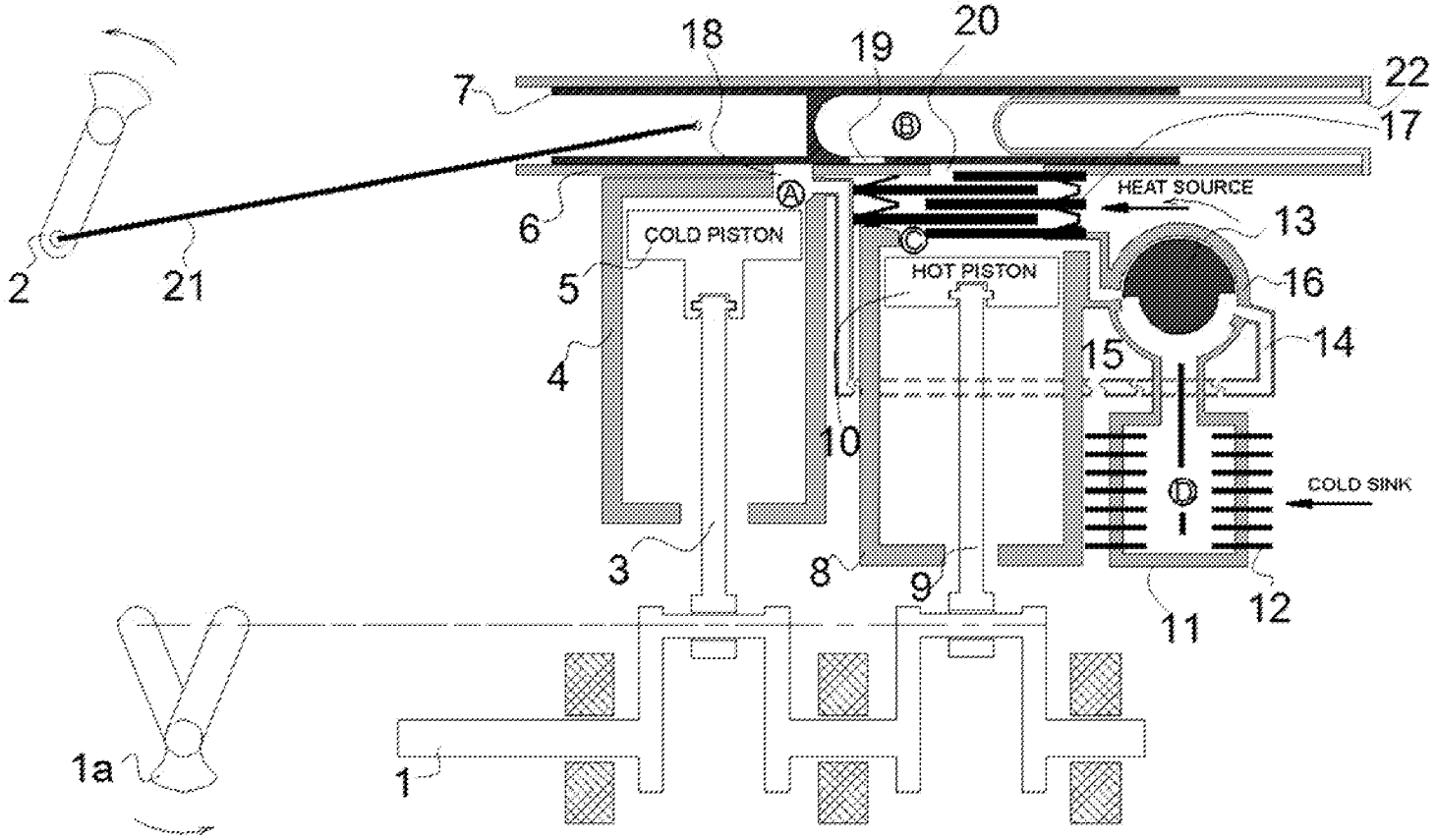
FIG. 2 is a simplified cross-sectional view of an in-line TSCVM external heat apparatus of FIG. 1, wherein the compression crankshaft throw angle is illustrated at 22.5 degrees after its TDC and the expansion crankshaft throw angle is illustrated at 22.5 degrees before the expansion piston reaches its TDC. The TSCVM crankshaft is 67.5 degrees after its BDC.
Figure 3:
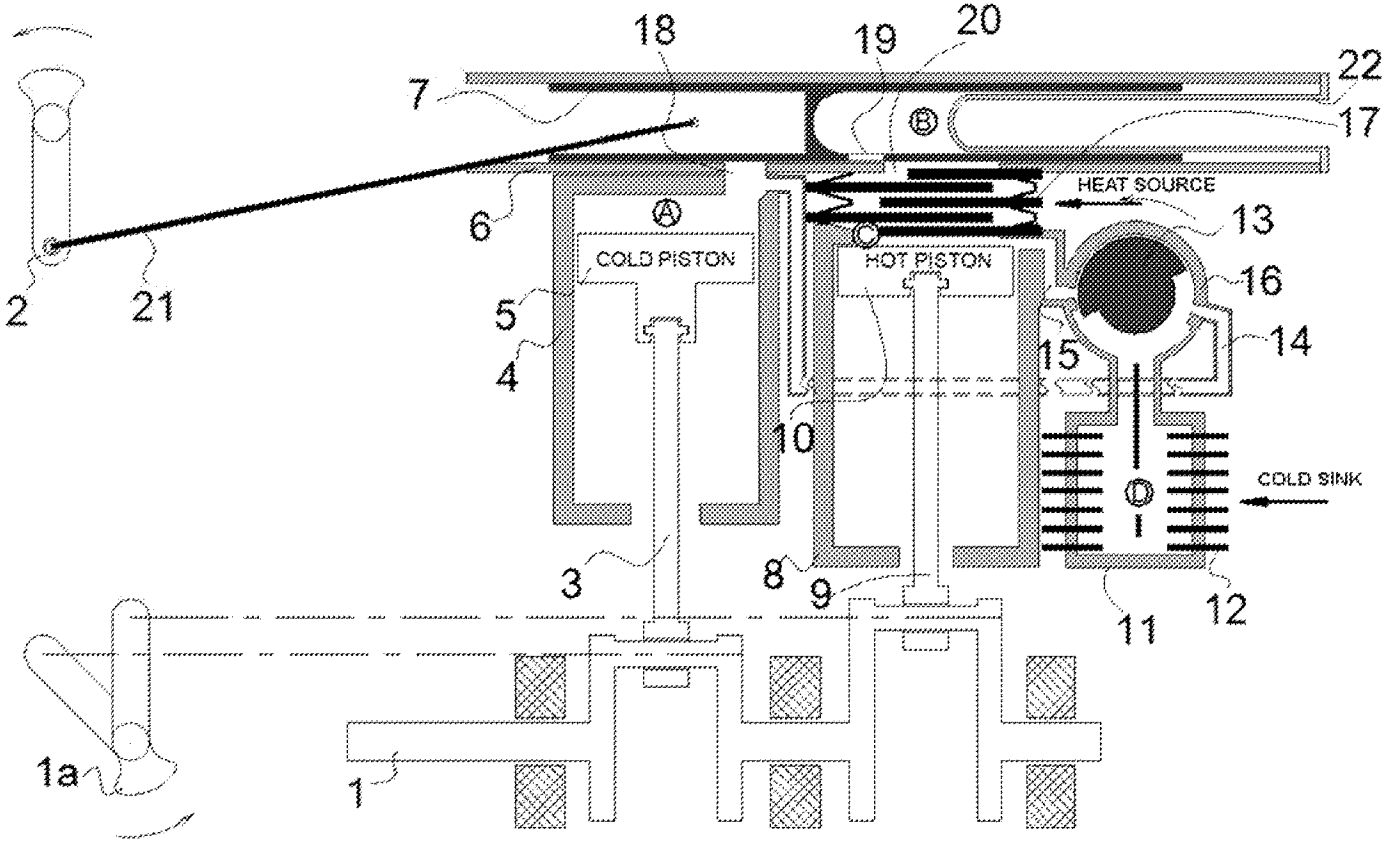
FIG. 3 is a simplified cross-sectional view of an in-line TSCVM external heat apparatus of FIG. 1, wherein the compression crankshaft throw angle is illustrated at 45 degrees after its TDC, and the expansion crankshaft throw angle is illustrated at its TDC. The TSCVM crankshaft is 90 degrees after its BDC.
Figure 4:
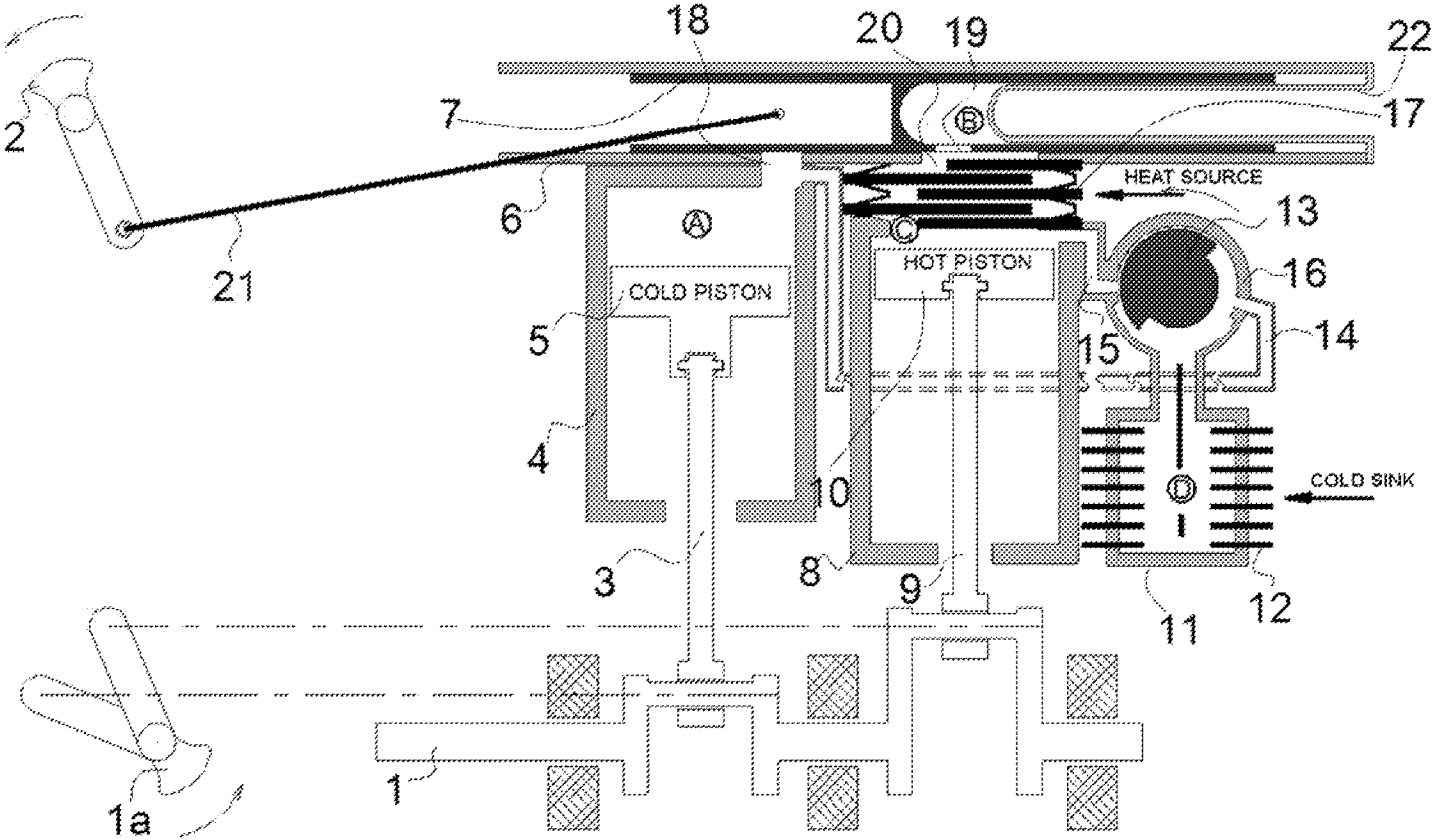
FIG. 4 is a simplified cross-sectional view of an in-line TSCVM external heat apparatus of FIG. 1, wherein the compression crankshaft throw angle is illustrated at 67.5 degrees after its TDC, and the expansion crankshaft throw angle is illustrated at 22.5 degrees after the expansion piston reaches its TDC. The TSCVM crankshaft is 67.5 degrees before its extreme right position (TDC).
Figure 5:
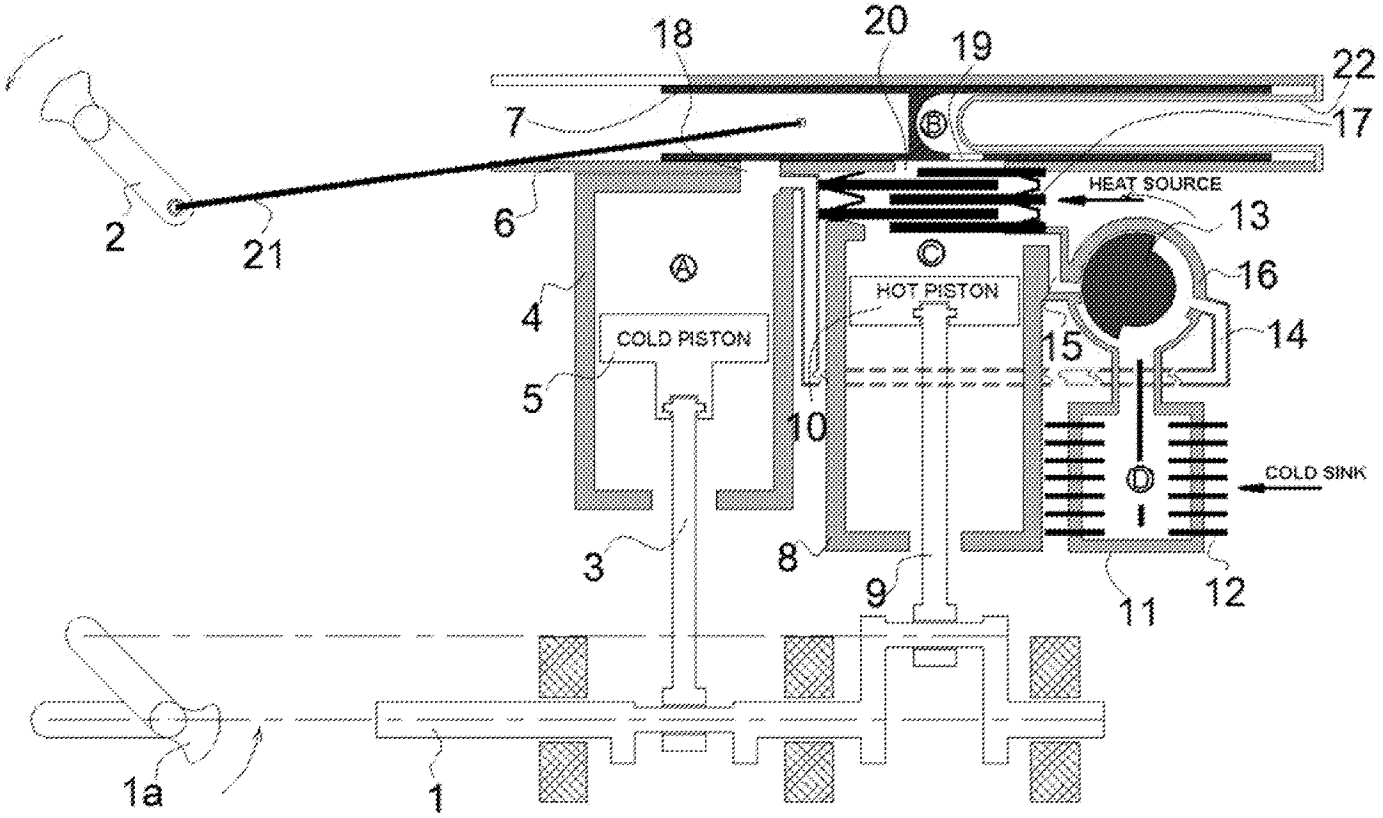
FIG. 5 is a simplified cross-sectional view of an in-line TSCVM external heat apparatus of FIG. 1, wherein the compression crankshaft throw angle is illustrated at 90 degrees after its TDC and the expansion crankshaft throw angle is illustrated at 45 degrees after the expansion piston reaches its TDC. The TSCVM crankshaft is 45 degrees before its TDC.
Figure 6:
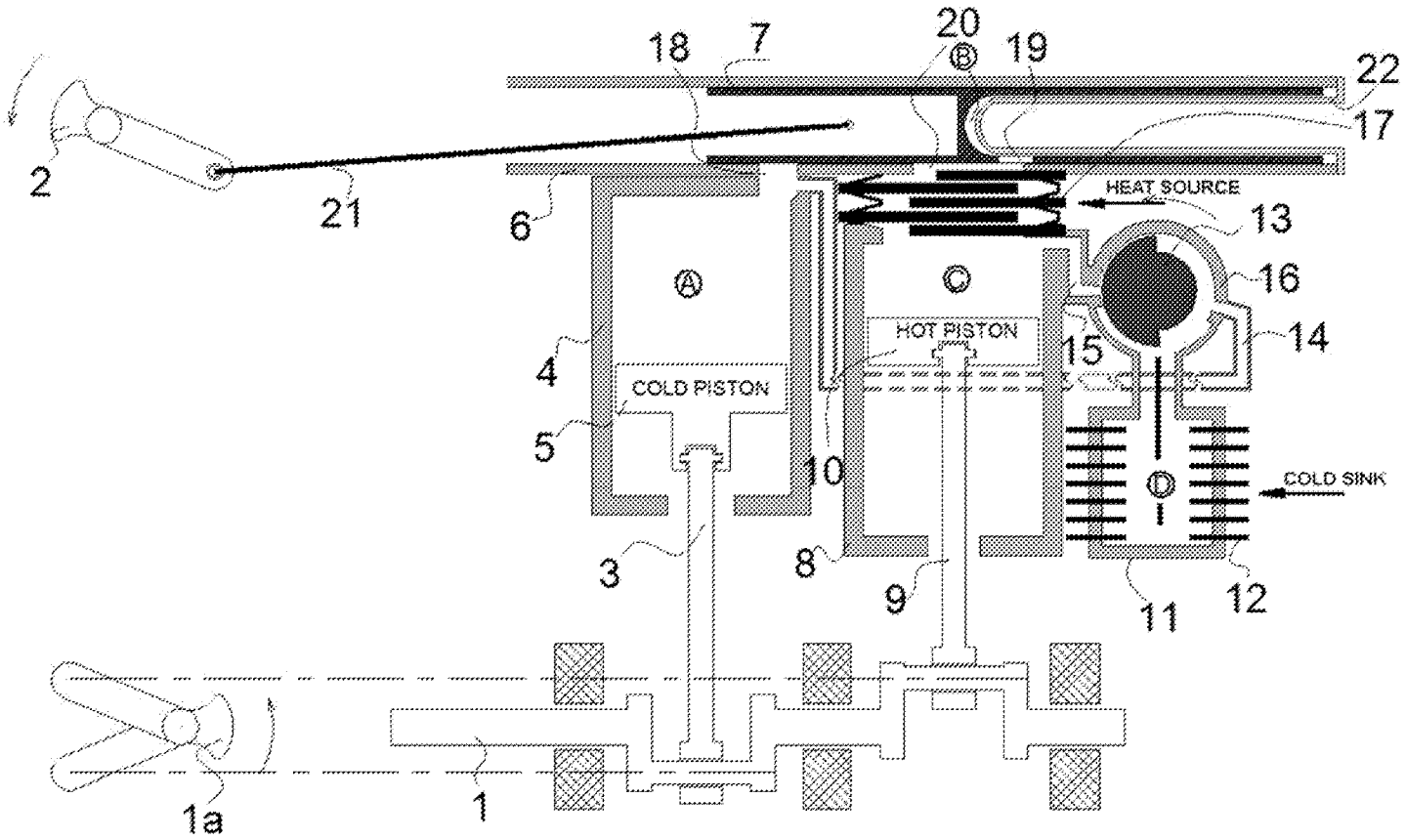
FIG. 6 is a simplified cross-sectional view of an in-line TSCVM external heat apparatus of FIG. 1, wherein the compression crankshaft throw angle is illustrated at 67.5 degrees before it reaches its Bottom Dead Center (BDC) and the expansion crankshaft throw angle is illustrated at 67.5 degrees after the expansion piston reaches its TDC. The TSCVM crankshaft is 22.5 degrees before its TDC.

Referring to FIG. 1, in accordance with one embodiment, an in-line configuration of an external heat engine includes: a compression cylinder 4, an expansion cylinder 8, a compression piston 5, an expansion piston 10, a cold chamber A, and a hot chamber C. It also includes two piston connecting rods 3 and 9, and a crankshaft 1 that actuate the pistons in the two cylinders.

Still referring to FIG. 1, the external heat engine also includes a TSCVM 7, a TSCVM cylinder 6, a transfer chamber B, which is located within the TSCVM 7, a TSCVM spool port 19, a TSCVM connecting rod 21, a TSCVM crankshaft 2, and a TSCVM cylinder extrusion 22.

Still referring to FIG. 1, the compression cylinder 4 is a piston engine cylinder that houses the compression piston 5, the cold chamber A, and the compression cylinder working fluid outlet port 18. The expansion cylinder 8 is a piston engine cylinder that houses the expansion piston 10, the hot chamber C and the expansion cylinder working fluid inlet port 20.

The connecting rods 3 and 9 connect their respective pistons to their respective crankshaft throws. The compression crankshaft 1 converts rotational motion into compression piston 5 reciprocating motion. The reciprocating motion of the expansion piston 10 is converted into rotational motion of crankshaft 1, which is converted to engine rotational motion or work (e.g., the crankshaft 1 may also serve as the engine output shaft). Both compression piston 5 and expansion piston 10 may have or may not have irregular structure or protrusions. The function of these protrusions may be to decrease the dead volume. Exemplary protrusions are disclosed in U.S. patent application Ser. No. 14/362,101, the content of which is incorporated herein by reference in its entirety.

In an exemplary embodiment, the TSCVM cylinder 6 houses the TSCVM 7 and both are placed on top and perpendicular to both compression cylinder 4 and expansion cylinder 8. TSCVM connecting rod 21 connect TSCVM 7 to TSCVM crankshaft 2. TSCVM crankshaft 2 converts rotational motion into TSCVM 7 reciprocating motion. TSCVM crankshaft 2 is mechanically connected via a mechanical linkage mechanism or gear train to crankshaft 1, thus crankshaft 1 drives TSCVM crankshaft 2, and hence the two crankshafts are synchronized. In another exemplary embodiment, a swash plate mechanism or a camshaft mechanism could be used to drive TSCVM 7. TSCVM 7 houses a spherical or oblong transfer chamber B, and a TSCVM port 19 (Chamber B may be thermally insulated).

During TSCVM 7 reciprocating motion, transfer chamber B alternates between being fluidly coupled to cold chamber A and hot chamber C. In some embodiments, transfer chamber B is fluidly coupled to only one of chamber A and chamber C at any one time. In other embodiments transfer chamber B is fluidly coupled to both chamber A and chamber C during some period or point of the engine cycle. Heat transfer elements 17 are placed between chamber B and C.

Still referring to FIG. 1, a cooling chamber D is connected to chamber A via a compression cylinder intake working fluid line 14 and to chamber C via expansion cylinder exhaust working fluid line 15. A three way valve 16 can connect chamber D to either one, both, or neither of chambers A and C. Chamber D is surrounded with cooling ribs 12. Working fluid reservoir 11 is the structure that hosts chamber D. Working fluid reservoir 11 may include means to direct the working fluid flow within the reservoir, such as the hot working fluid will be forced to travel within the reservoir before exiting it as cold working fluid (vertical black line within reservoir 11). Chamber D and working fluid reservoir 11 serves as a heat exchanger, and as known in the art, will be designed as to accept hot working fluid and supply cold working fluid in an optimal manner.

In another embodiment, during TSCVM 7 reciprocating motion and at a fraction of crankshaft 2 rotational cycle, transfer chamber B could be fluidly connected to both cold chamber A and hot chamber C.

During TSCVM 7 reciprocating motion, transfer chamber B, via TSCVM port 19, may fluidly couple or decouple from chamber A.

During TSCVM 7 reciprocating motion, transfer chamber B, via TSCVM port 19, may be fluidly couple or decouple from chamber C.

Figure 19:
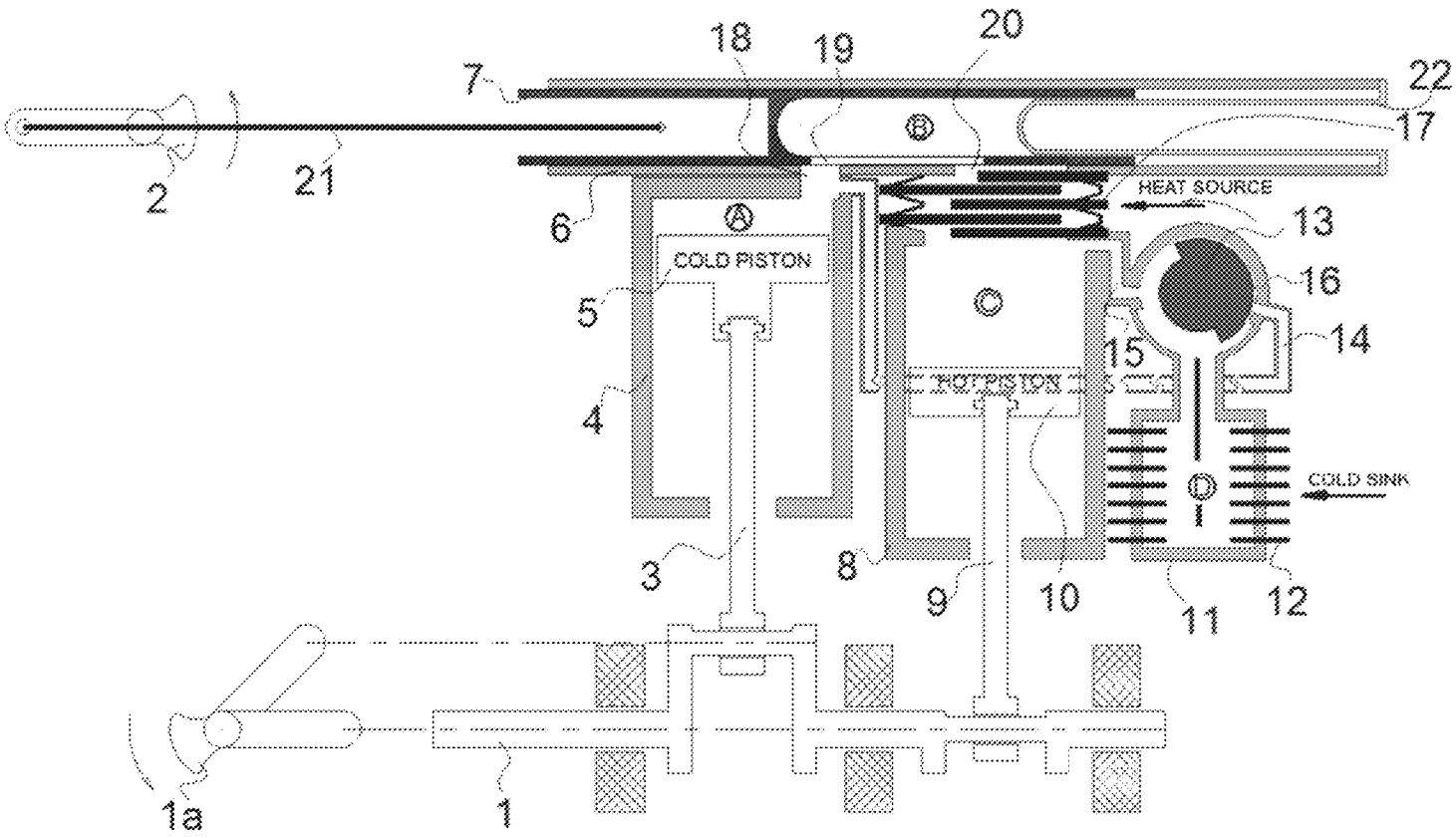
FIG. 19 is a simplified cross-sectional view of an in-line TSCVM external heat apparatus of FIG. 1, similar to FIG. 15, wherein the TSCVM is simultaneously fluidly coupled with the compression chamber and the expansion chamber.

During TSCVM 7 reciprocating motion, when transfer chamber B, via TSCVM port 19 is neither coupled to chamber A via port 18 nor to chamber C via port 20, TSCVM port 19 remains sealed. In some embodiments, TSCVM port 19 simultaneously couples to Chamber A and Chamber C during a portion of a cycle of the engine (as illustrated in FIG. 19).

In exemplary embodiments, predetermined phase delay is introduced via crankshaft 1, such that compression piston 5 leads or follows expansion piston 10. FIGS. 1-16 depicts one such exemplary embodiment in which the predetermined phase delay that is introduced via crankshaft 1, is such that compression piston 5 leads the expansion piston 10 by 45 degree crank angle, as exemplified in a side view depiction of crankshaft 1, labeled 1*a* in FIG. 1.

In one embodiment, the three way valve 16 may open to fluidly connect chambers A and D in a range of crankshaft degrees starting when compression piston 5 reaches its TDC (give or take a few degrees) and until it reaches its BDC (give or take a few degrees). During this time the three way valve 16 disconnect chambers D and C. Within piston phase-lag angle range, before and after compression piston 5 and expansion piston 10 passes through their respective TDCs and BDCs some overlay or underlay is allowed, i.e., both valve 16 transfer passages 14 and 15 may be closed or open at same time.

In one embodiment, the three way valve 16 may open to fluidly connect chambers C and D in a range of crankshaft degrees starting when expansion piston 10 reaches its BDC (give or take a few degrees) and until it reaches its TDC (give or take a few degrees). During this time the three way valve 16 disconnects chambers D and A. Within piston phase lag angle range, before and after compression piston 5 and expansion piston 10 passes through their respective TDCs and BDCs some overlay or underlay is allowed, i.e., both valve 16 passages 14 and 15 may be closed or open at same time.

In one embodiment, the TSCVM cylinder 6 houses TSCVM 7 and both are placed on top and perpendicular to both compression cylinder 4 and expansion cylinder 8. The TSCVM connecting rod 21 connects TSCVM 7 to TSCVM crankshaft 2. TSCVM crankshaft 2 converts rotational motion into TSCVM 7 reciprocating motion. TSCVM 7 houses a spherical (for example) transfer chamber B, and a TSCVM port 19. During TSCVM 7 reciprocating motion, transfer chamber B alternate between being fluidly connected to cold chamber A and/or hot chamber C.

Referring again to FIG. 1, within the compression cylinder 4 is compression piston 5. The compression piston 5 moves relative to the compression cylinder 4 in the upward direction toward its TDC. Within the expansion cylinder 8 is an expansion piston 10. The expansion piston 10 moves relative to the expansion cylinder 8 in the upward direction as well as toward its TDC. The compression cylinder 4 and the compression piston 5 define cold chamber A. The expansion cylinder 8 and the expansion piston 10 define hot chamber C. In some embodiments, the expansion piston 10 moves in advance of the compression piston 5.

During an expansion stroke, in which the engine is producing work, the expansion piston 10 may push the expansion connecting rod 9, causing the crankshaft 1 to rotate. During an exhaust stroke, inertial forces (which may be initiated by a flywheel mass—not shown) cause crankshaft 1 to continue its rotation, and cause the expansion connecting rod 9 to move expansion piston 10 toward its TDC, which in turn exhausts working fluid through line 15 (conduit) into cooling chamber D as illustrated in FIGS. 11-16 and FIGS. 1-2. Crankshaft 1 rotation move compression piston 5 and expansion piston 10 in synchronous but phase-lagged rotation (i.e. both crankshaft throws rotate at the same speed but may differ in their respective crank angles).

Referring to FIG. 1, crankshaft 1 converts rotational motion via connecting rod 3 into compression piston 5 reciprocating motion within its cylinder housing 4.

In various exemplary embodiments, crankshaft 1 structural configurations may vary in accordance with desired engine configurations and designs. For example, possible crankshaft design factors may include: the number of crankshafts, the number of dual cylinders, the relative cylinder positioning, the crankshaft gearing mechanism, and the direction of rotation. In one exemplary embodiment, a single crankshaft would actuate both compression piston 5 and expansion piston 10 via compression connecting rod 3 and expansion piston connecting rod 9. Such single crankshaft could actuate multiple pairs of compression piston 5 and expansion piston 10.

FIGS. 1 through 16 illustrate perspective views of the two-cylinder crankshafts 1 throws, which are coupled to respective piston connecting rods 3 and 9. The two-cylinder crankshafts 1 throws may be oriented relatively to each other such as to provide a predetermined phase difference between the otherwise synchronous motion of pistons 5 and 10. A predetermined phase difference between the TDC positions of the compression piston and expansion piston may introduce a relative piston phase delay or advance. In exemplary embodiments, as illustrated in FIGS. 1 to 16, a phase delay is introduced such that the compression piston 5 moves 45 degrees ahead of expansion piston 10.

As illustrated in FIGS. 1 through 16, once crankshaft 1 rotation starts (via external starter, not shown) both pistons 5 and 10 begin their reciprocating motion.

As illustrated in FIG. 1, the intake stroke begins when the compression piston 5 reaches its TDC and the three way valve 16 opens to fluidly connect chambers A and D via compression cylinder intake working fluid line (conduit) 14. As the compression piston moves towards its BDC (FIGS. 1-9) chamber A volume increases causing colder working fluid to move from chamber D to chamber A.

The compression stroke begins when compression piston 5 passes through its BDC point and the three ways valve 16 disconnects chambers A from D (FIGS. 10-16 and FIG. 1) trapping the working fluid in chamber A. While crankshafts rotation continues (as shown in FIGS. 10-16 and FIG. 1), chamber A volume decreases and the temperature and pressure of the working fluid increases. During the latter part of this portion of the cycle where chamber A volume decreases (FIGS. 13-16) TSCVM 7 position is such that the transfer chamber B via TSCVM port 19 is fluidly coupled with chamber A. Hence, during the compression stroke the working fluid is being compressed into chamber B such as at the end of the compression stroke when compression piston 5 reaches its TDC (FIG. 1) all the working fluid has been transferred from chamber A to chamber B.

Figure 7:
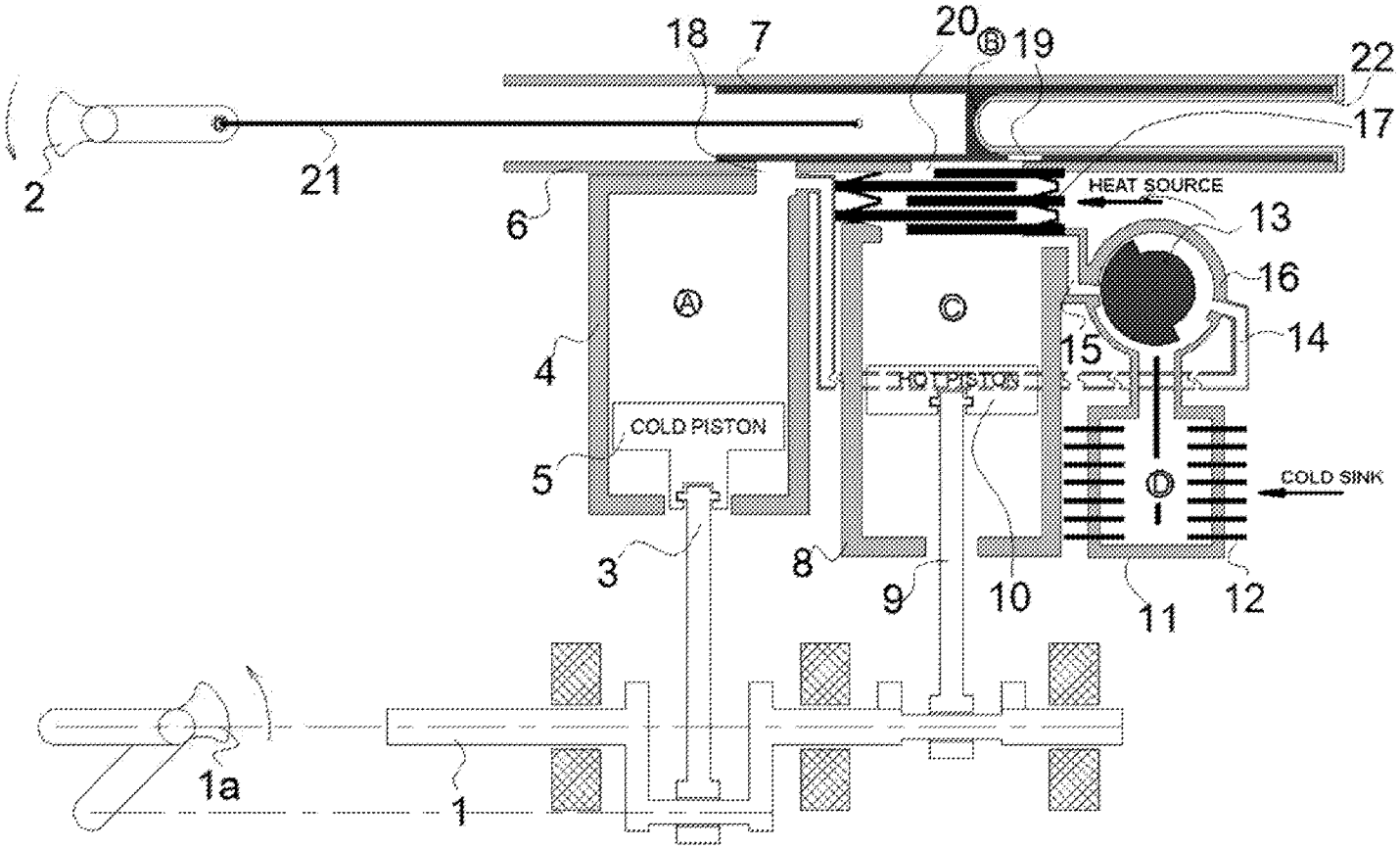
FIG. 7 is a simplified cross-sectional view of an in-line TSCVM external heat apparatus of FIG. 1, wherein the compression crankshaft throw angle is illustrated at 45 degrees before it reaches its BDC and the expansion crankshaft throw angle is illustrated at 90 degrees after the expansion piston reaches its TDC. The TSCVM crankshaft reaches its TDC.
Figure 8:
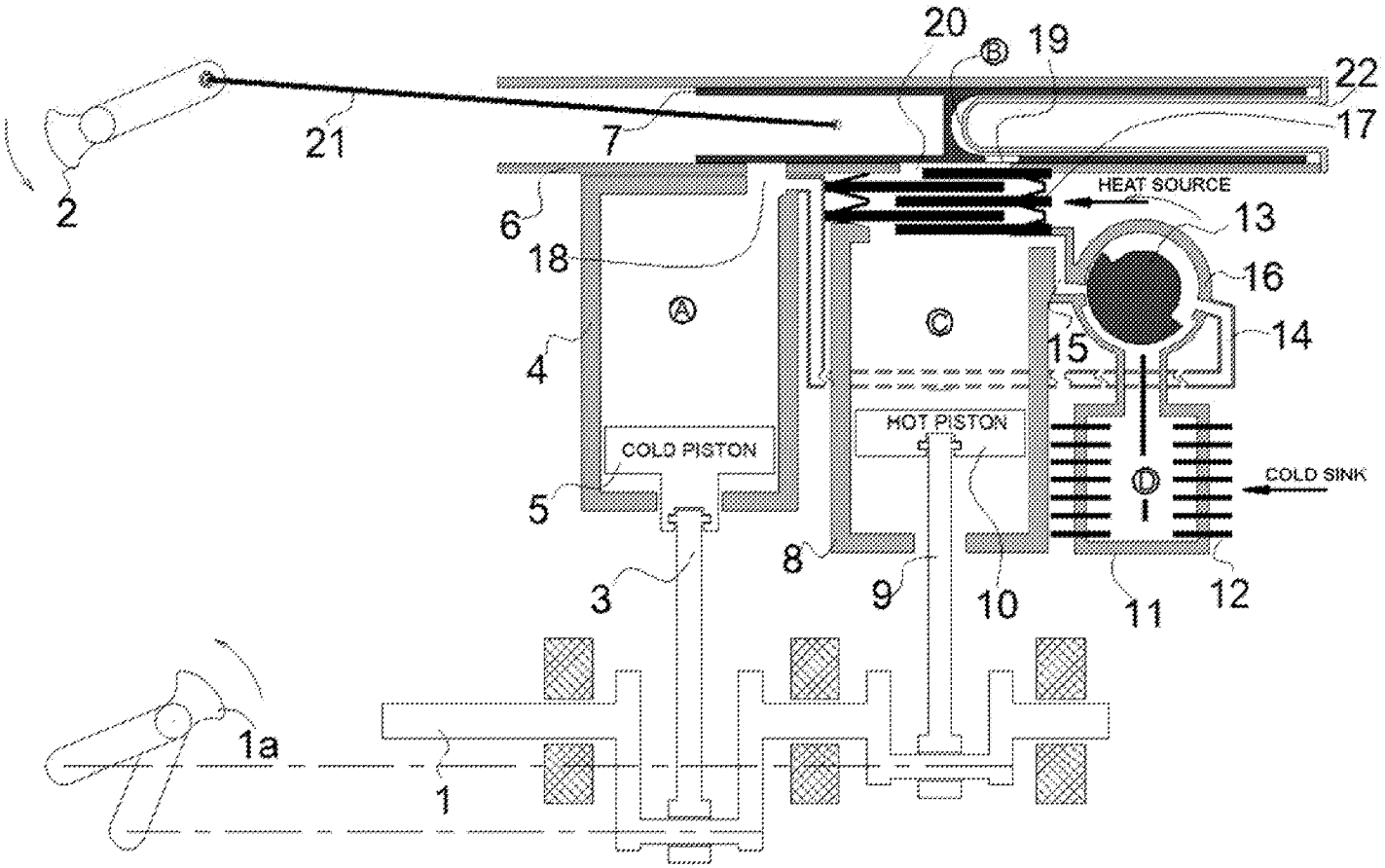
FIG. 8 is a simplified cross-sectional view of an in-line TSCVM external heat apparatus of FIG. 1, wherein the compression crankshaft throw angle is illustrated at 22.5 degrees before it reaches its BDC and the expansion crankshaft throw angle is illustrated at 67.5 degrees before the expansion piston reaches its BDC. The TSCVM crankshaft is 22.5 degrees after its TDC.
Figure 9:
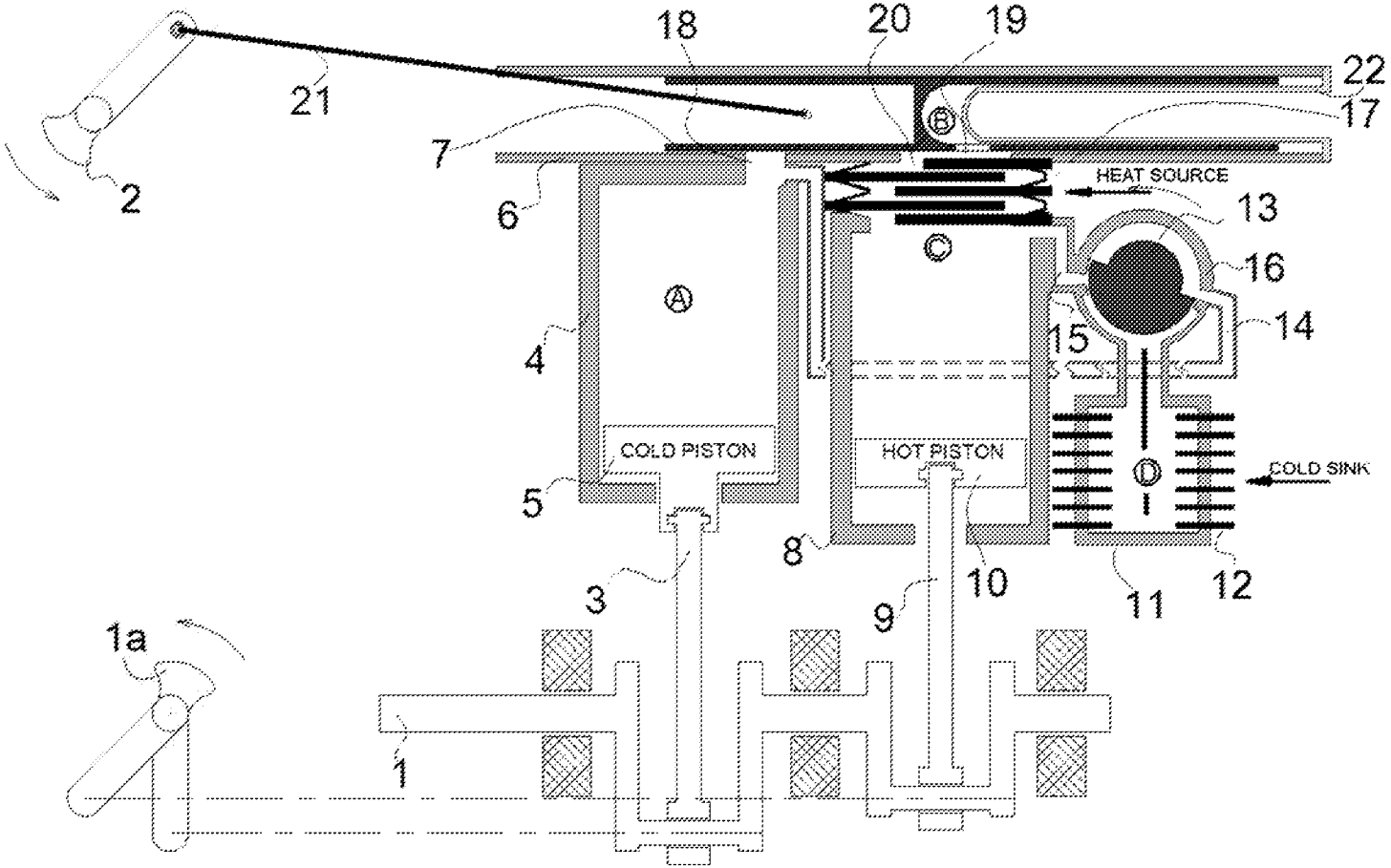
FIG. 9 is a simplified cross-sectional view of an in-line TSCVM external heat apparatus of FIG. 1, wherein the compression crankshaft throw angle is illustrated at its BDC and the expansion crankshaft throw angle is illustrated at 45 degrees before the expansion piston reaches its BDC. The TSCVM crankshaft is 45 degrees after its TDC.
Figure 10:
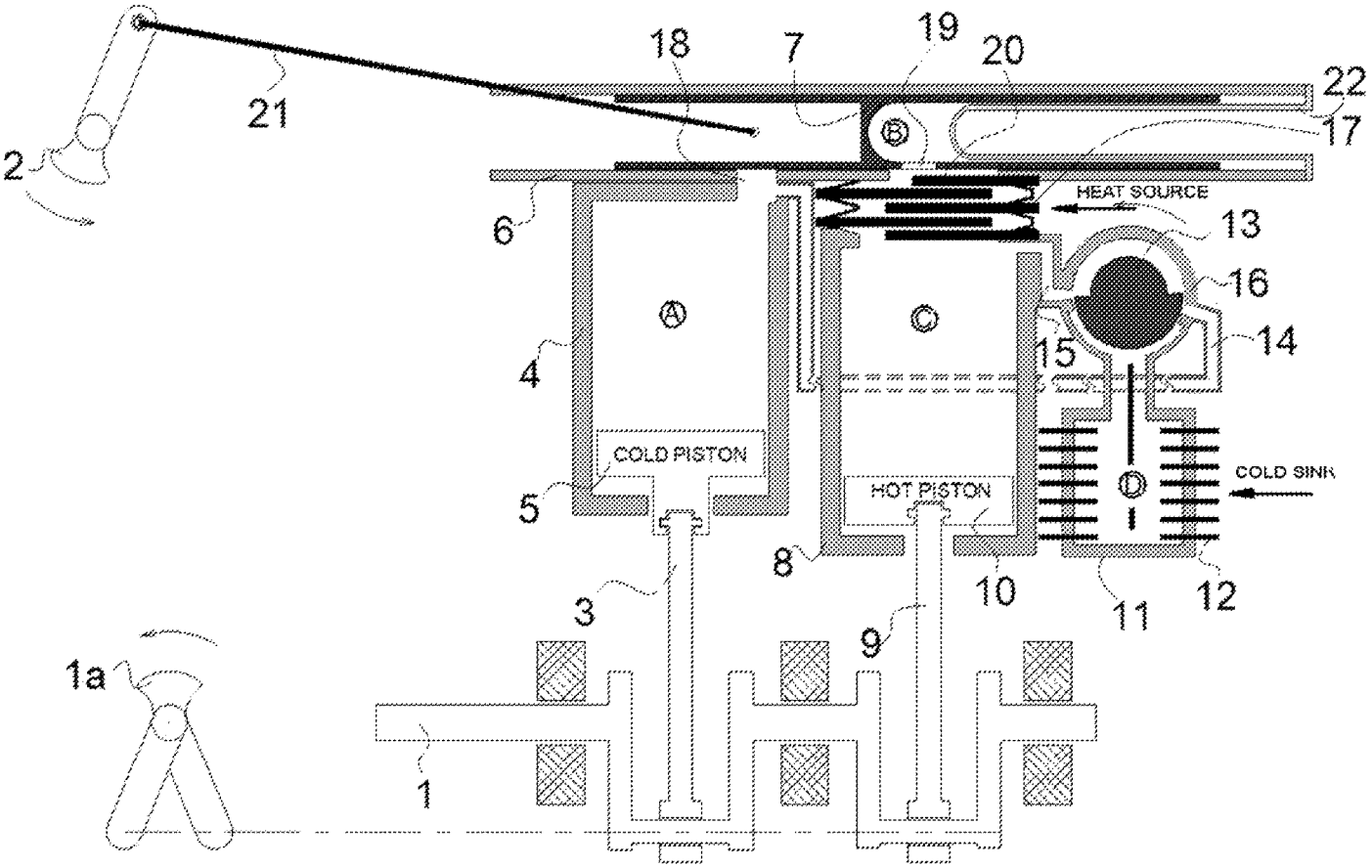
FIG. 10 is a simplified cross-sectional view of an in-line TSCVM external heat apparatus of FIG. 1, wherein the compression crankshaft throw angle is illustrated at 22.5 degrees after its BDC and the expansion crankshaft throw angle is illustrated at 22.5 degrees before the expansion piston reaches its BDC. The TSCVM crankshaft is 67.5 degrees after its TDC.
Figure 11:
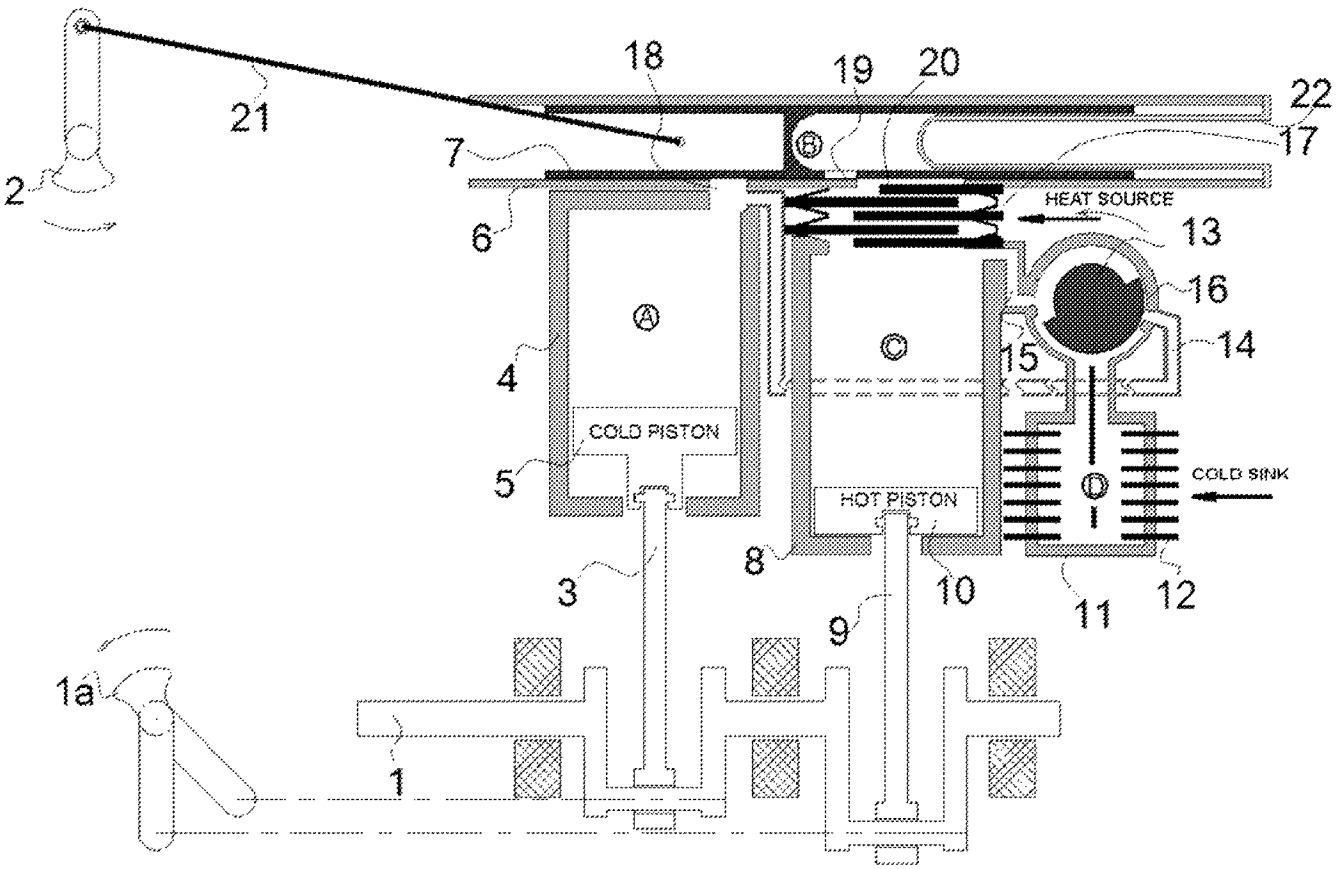
FIG. 11 is a simplified cross-sectional view of an in-line TSCVM external heat apparatus of FIG. 1, wherein the compression crankshaft throw angle is illustrated at 45 degrees after its BDC and the expansion crankshaft throw angle is illustrated at its BDC. The TSCVM crankshaft is 90 degrees after its TDC.
Figure 12:
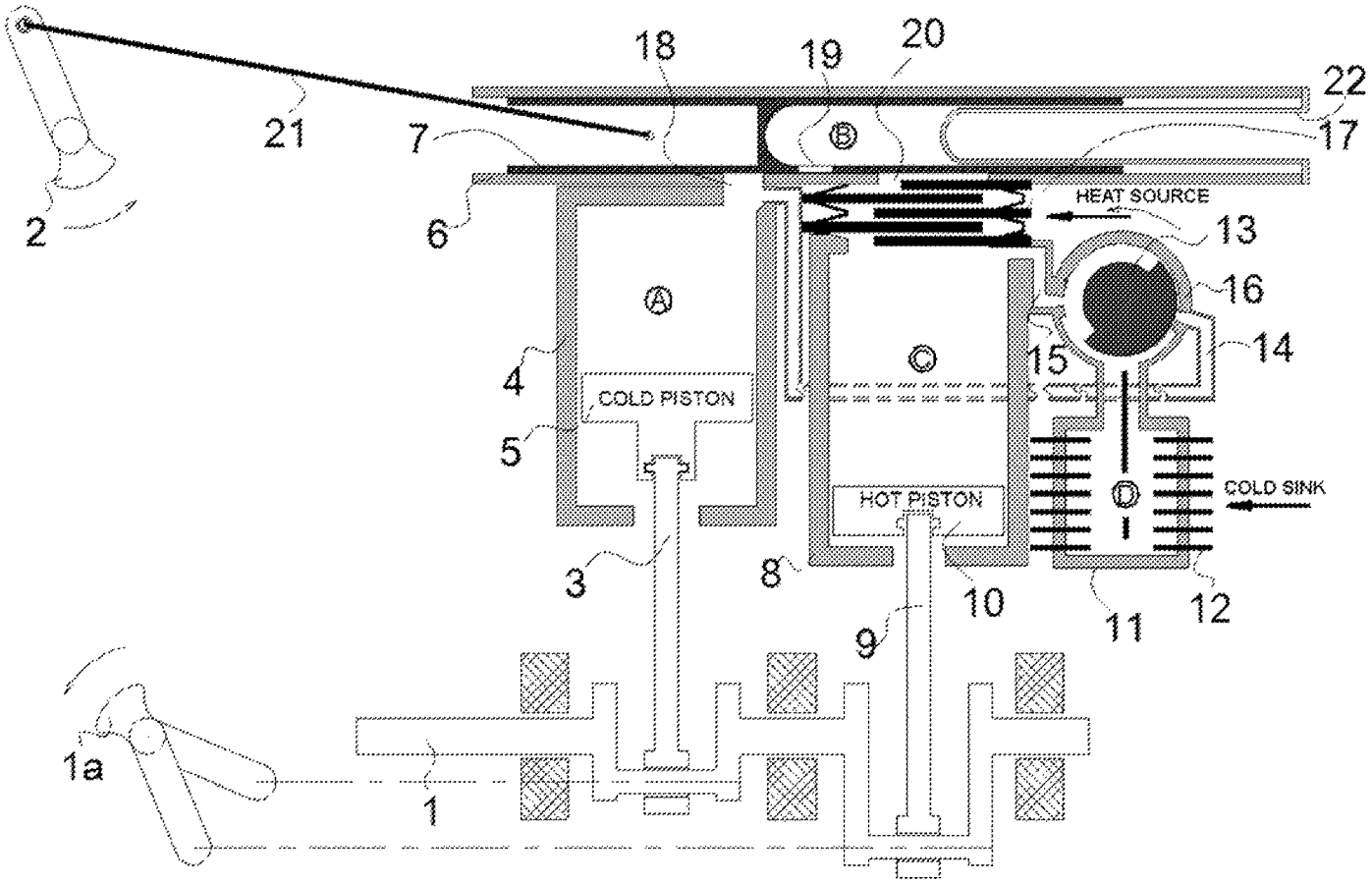
FIG. 12 is a simplified cross-sectional view of an in-line TSCVM external heat apparatus of FIG. 1, wherein the compression crankshaft throw angle is illustrated at 67.5 degrees after its BDC and the expansion crankshaft throw angle is illustrated at 22.5 degrees after the expansion piston reaches its BDC. The TSCVM crankshaft is 67.5 degrees before its BDC.
Figure 13:
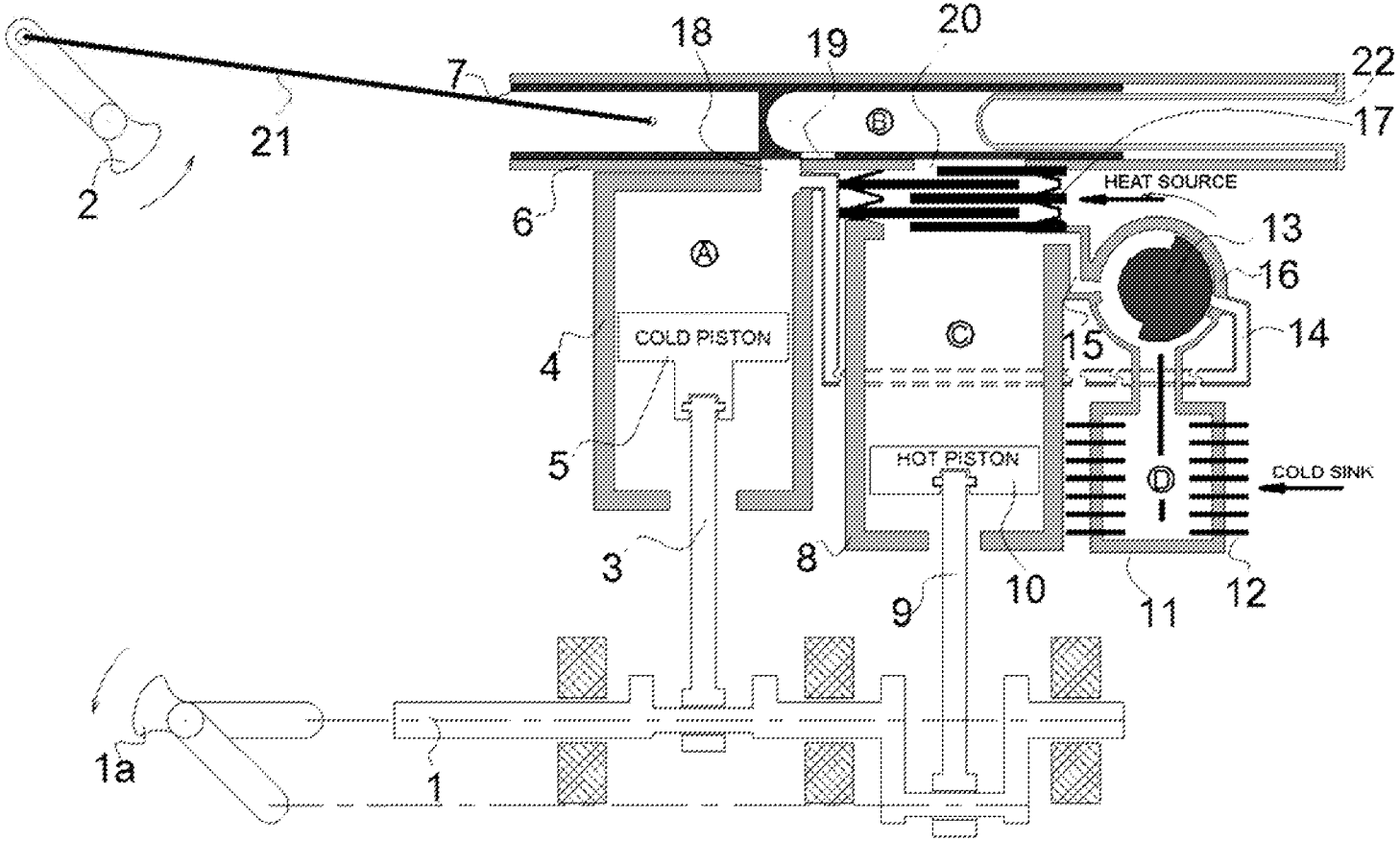
FIG. 13 is a simplified cross-sectional view of an in-line TSCVM external heat apparatus of FIG. 1, wherein the compression crankshaft throw angle is illustrated at 90 degrees after its BDC and the expansion crankshaft throw angle is illustrated at 45 degrees after the expansion piston reaches its BDC. The TSCVM crankshaft is 45 degrees before its BDC.
Figure 14:
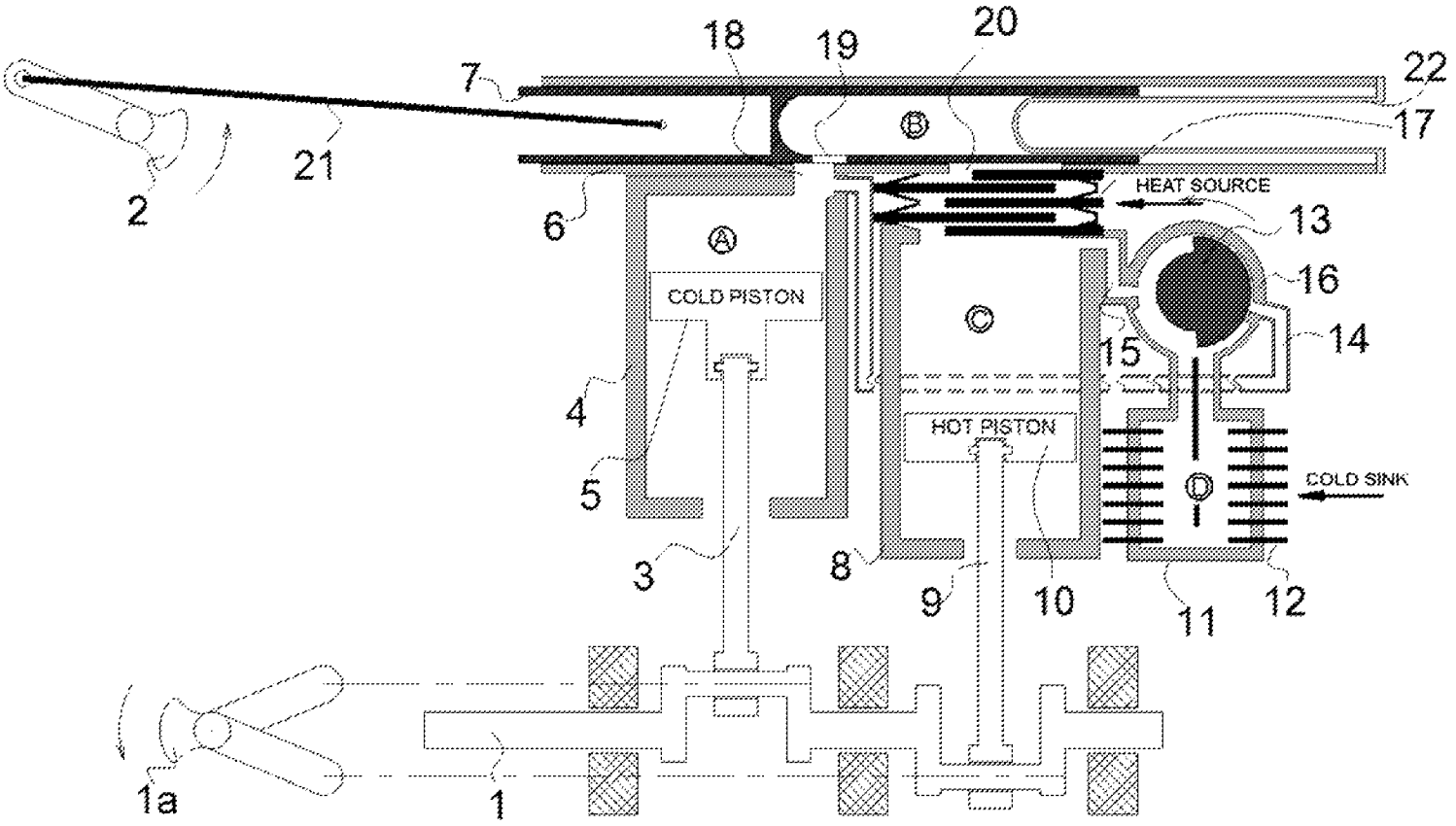
FIG. 14 is a simplified cross-sectional view of an in-line TSCVM external heat apparatus of FIG. 1, wherein the compression crankshaft throw angle is illustrated at 67.5 degrees before it reaches its TDC and the expansion crankshaft throw angle is illustrated at 67.5 degrees after the expansion piston reaches its BDC. The TSCVM crankshaft is 22.5 degrees before its BDC.
Figure 15:
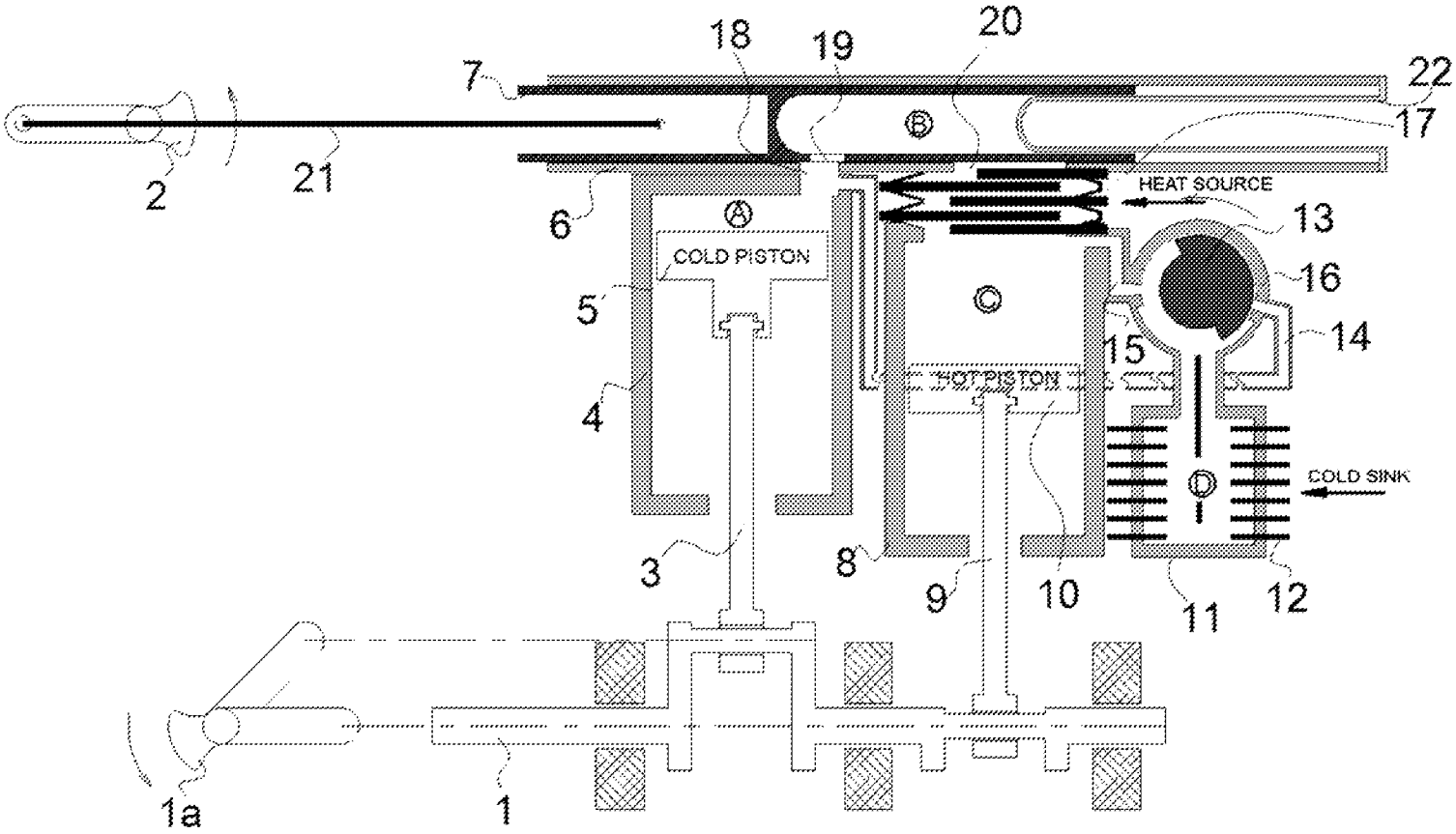
FIG. 15 is a simplified cross-sectional view of an in-line TSCVM external heat apparatus of FIG. 1, wherein the compression crankshaft throw angle is illustrated at 45 degrees before it reaches its TDC and the expansion crankshaft throw angle is illustrated at 90 degrees after the expansion piston reaches its BDC. The TSCVM crankshaft is at its BDC.
Figure 16:
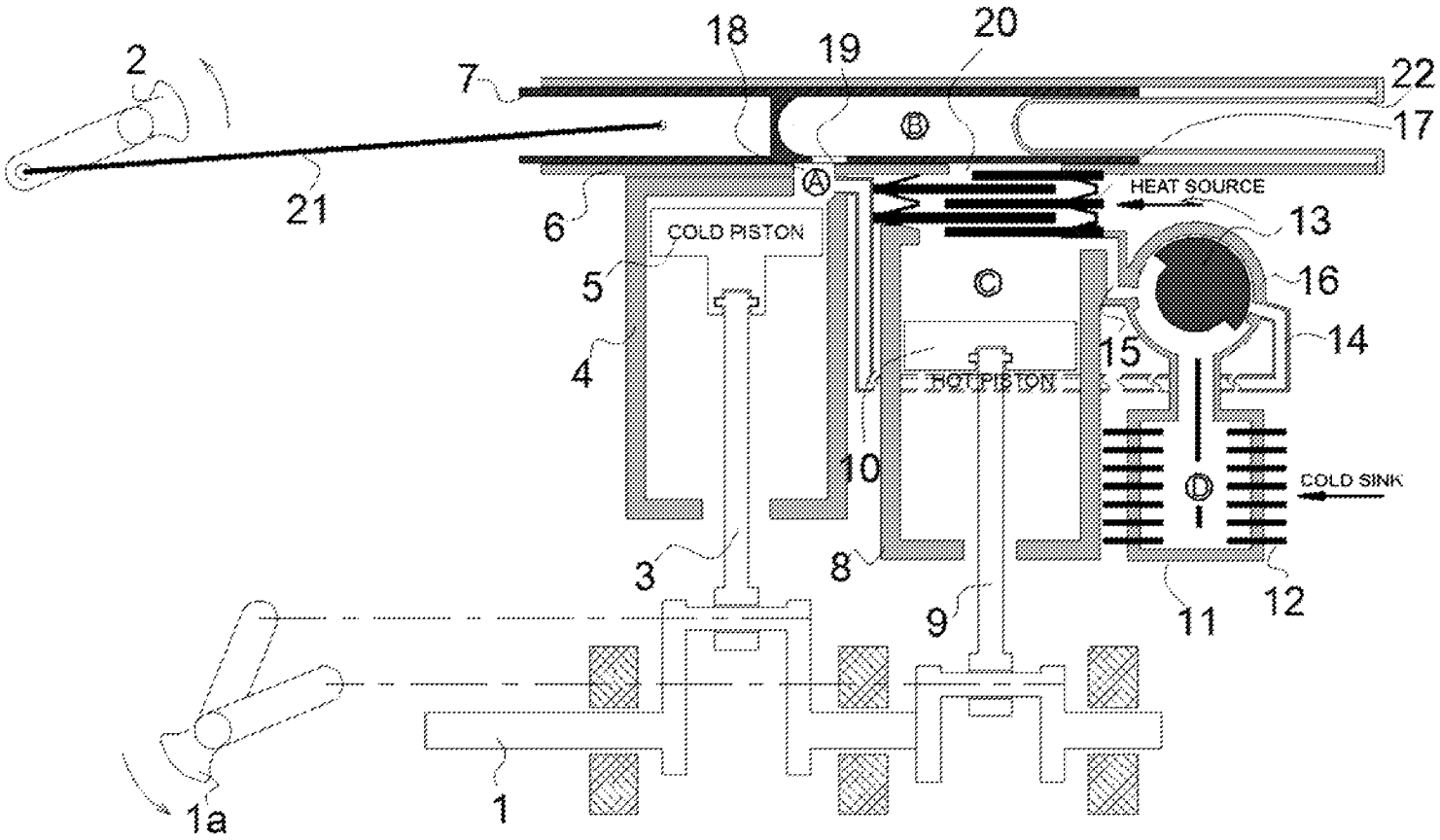
FIG. 16 is a simplified cross-sectional view of an in-line TSCVM external heat apparatus of FIG. 1, wherein the compression crankshaft throw angle is illustrated at 22.5 degrees before it reaches its TDC and the expansion crankshaft throw angle is illustrated at 67.5 degrees before the expansion piston reaches its TDC. The TSCVM crankshaft is 22.5 degrees after its BDC.

After the TSCVM 7 reaches its BDC (FIG. 15) and moves towards its TDC (FIGS. 15-16 and FIGS. 1-7) the volume of chamber B decreases because it move towards the static TSCVM cylinder extrusion 22, until TSCVM reaches its TDC (FIG. 7). Consequently, the pressure of the working fluid trapped in chamber B may continue to increase (FIGS. 1-7).

As noted, the TSCVM transfer chamber includes an internal volume that decreases during transfer of the working fluid from the compression chamber A to the expansions chamber B. Decreasing the internal volume of the transfer chamber during transfer of the working fluid may advantageously increase the efficiency of the engine. For example, the decreasing volume may further increase the pressure of the working fluid prior to transfer, thus increasing the compression ratio of the engine.

In some embodiments, the transfer chamber further compresses the working fluid received from the compression chamber. By further compressing and transferring the working fluid, some embodiments may advantageously minimize "dead space." Some embodiments may also increase the amount of compressed working fluid that is transferred to participate in the expansion stroke.

As described above, the transfer chamber may further compress the working fluid received from the compression chamber. In some embodiments, the transfer chamber B compresses while transferring working fluid to the expansion chamber C. This may happen if TSCVM 7 reaches its TDC at the same time expansion piston 10 reaches its TDC (not shown). In some embodiments, there is no further compression, just transfer, of working fluid (for example, if the expansion piston clears more space, i.e., moves away from its TDC, than space is reduced in chamber B due to TSCVM 7 movement towards the static TSCVM cylinder extrusion 22). In some embodiments, the working fluid is undergoing compression in the transfer chamber during part of the cycle and expansion during the end of the transfer (for example, if the expansion piston clears more space than the transfer chamber covers; this may occur just at the end of the transfer process). Note that all three conditions—compression, no change, and expansion—of the working fluid may happen during the same working fluid transfer process at different stages of the cycle. Although some descriptions herein may describe working fluid that is further compressed during a fraction of the transfer process, it should be noted that is one embodiment of the claimed subject matter and is offered for illustrative purposes.

In the examples described herein, the transfer chamber includes a transfer cylinder, a transfer cylinder extrusion, and a transfer cylinder housing. As used herein, a transfer cylinder extrusion can be understood to be a structure positioned within a transfer cylinder that provides a portion of a boundary of the transfer chamber. The transfer cylinder extrusion may be moveable relative to an internal wall of the transfer cylinder to reduce the volume in the transfer chamber. The transfer cylinder is positioned within and moves relative to the transfer cylinder housing, and the transfer cylinder extrusion is positioned within the transfer cylinder and does not move relative to the transfer cylinder housing. In some further embodiments, the extrusion has a parabolic head.

One of skill in the art will recognize that the depicted cylinder, extrusion, and housing is one example of a transfer chamber that has an internal volume that decreases during transfer. Other examples include, but are not limited to, a transfer piston and transfer cylinder. In this example, ports on a transfer cylinder wall may fluidly couple the compression chamber to the transfer chamber and the expansion chamber to the transfer chamber. Yet further examples may include a conduit that is gated open to the transfer cylinder after the transfer piston finishes transfer of the working fluid and is on its way back to connect with the compression chamber (cylinder). Through this conduit cold working fluid can be introduced to the transfer chamber. Once the transfer piston start its movement back toward the expansion cylinder, this gate may close.

The expansion stroke begins as piston 10 reaches its TDC and the TSCVM 7 reciprocal motion toward its TDC cause transfer chamber B and chamber C to be fluidly coupled as TSCVM port 19 aligns with expansion cylinder working fluid inlet port 20 (FIGS. 3-11). The working fluid that was further compressed in chamber B is now transferred and expands via heating elements 12 and into chamber C. In some embodiments, heating elements 12 internal working fluid volume can be designed to minimize dead space while maximizing its heat exchange. The heated (by heating elements 12) working fluid is further expanded, pushing the expansion piston 10 towards its BDC to generate the power stroke (engine work). All the working fluid is transferred from chamber B trough heating elements 12 and into chamber C because the volume of chamber B decrease to zero as the TSCVM crankshaft 2 moves toward its TDC and the static TSCVM cylinder extrusion 22 nullifies chamber B's volume (FIG. 7).

As will be recognized by one of skill in the art, heating elements 12 are optional and can be added to provide efficient transfer of heat from an external heat source to the working fluid. Further, although the heat elements 12 in FIGS. 1-16 are illustrated between the transfer chamber and the expansion chamber, it should be appreciated that the heating elements could be located in other parts of the engine, either partially or fully. For example, elements of a heat exchanger may be located around the transfer chamber. A transfer chamber heat exchanger may extract heat from working fluid within the transfer chamber (e.g. for further compression or to increase compression efficiency), may add heat to working fluid within the transfer chamber (e.g., to add exergy to the working fluid), or both.

As shown in FIGS. 7-10, in one exemplary embodiment, after TSCVM 7 reaches its TDC (FIG. 7) and start its movement towered its BDC (FIG. 8-10), a portion of the working fluid may be transferred back from Chamber C to Chamber B, absorb additional heat from heating elements 12, and/or additional heating elements of a heat exchanger that may be located around the transfer chamber B. This added heat might produce more work by helping push the expansion piston 10 towered its BDC and TSCVM 7 toward its BDC.

The exhaust stroke begins after the expansion piston 10 passes through its BDC at the end of the power stroke and starts moving toward its TDC (FIGS. 11-16 and 1-3). The working fluid now residing in chamber C is pushed out from chamber C through the expansion cylinder exhaust working fluid line (conduit) 15 into chamber D. This is because during that time the three way valve 16 opens to fluidly connect chambers C and D and TSCVM 7 position is such that the transfer chamber B and chamber C are disconnected.

Figure 17:
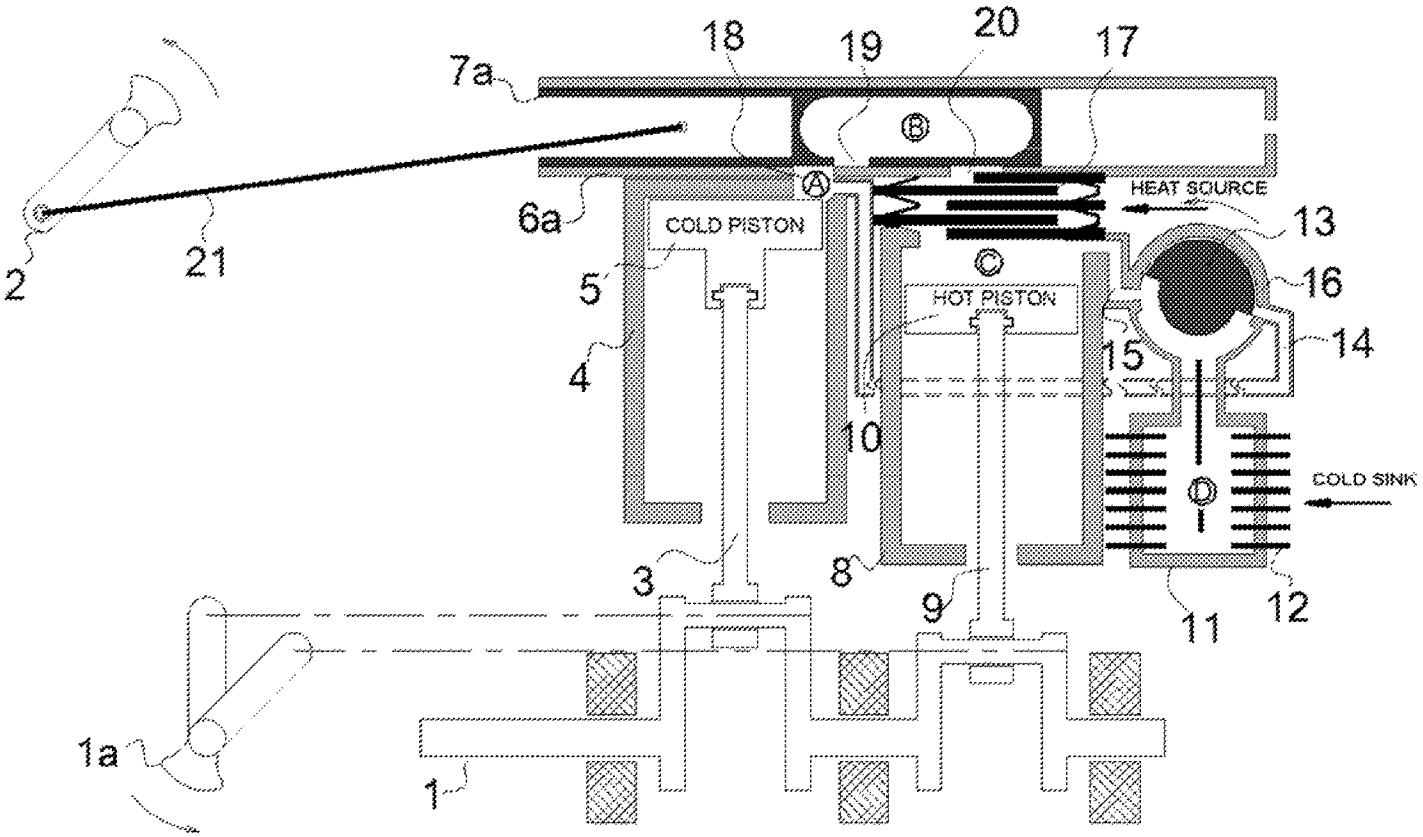
FIG. 17 is a simplified cross-sectional view of an in-line TSCVM external heat apparatus, in accordance with exemplary embodiments, wherein the TSCVM has constant volume. The crankshaft throw angle is illustrated where the compression piston reaches its Top Dead Center (TDC) and the expansion crankshaft throw angle is illustrated at 45 degrees before the expansion piston reaches its TDC. The TSCVM crankshaft is 45 degrees after its BDC.

In various exemplary embodiments illustrated in FIG. 17, there is no extrusion associated with TSCVM cylinder **6*a* (compare to TSCVM cylinder extrusion 22 seen in FIGS. 1-16), and chamber B has constant volume in TSCVM 7*a***.

The reservoir chamber D may hold more working fluid than is compressed during the compression stroke enabling longer cooling period for the working fluid used in the engine cycle.

All moving pistons, including TSCVM 7 may be sealed utilizing sealing-rings as known in the art. Regarding TSCVM, sealing rings may be added between the transfer cylinder TSCVM 7 and transfer cylinder housing 6 and between the transfer cylinder TSCVM 7 and transfer cylinder extrusion 22.

In external combustion engines, the working fluid can be air or other gases such as helium or hydrogen, for example. The initial working fluid pressure enclosed within the engine may (or may not) be pressurized beyond (or beneath) atmospheric pressure.

The three way valve 16 directs hot cylinder exhaust working fluid into cooling chamber D and colder working fluid from cooling chamber D into compression chamber A. There are several, known in the art, ways to implement this valve, such as a three way rotary valve type, a spool within a sleeve three way valve type, or to use two each "dual position" (open/close; poppet valves, for example) valve types, for example.

The cold cylinder (compression cylinder) may be externally cooled, using ribs and/or water cooling mechanism, for example.

In a preferred embodiment, the reservoir chamber D is externally cooled, by using cooling ribs 12, for example.

The hot cylinder (expansion cylinder) may be externally heated by an external heat source.

In another exemplary embodiment, which uses as the working fluid ambient air, items 11-15 of FIGS. 1-17 would not be used. Instead, ambient air would enter chamber A trough an intake valve (not shown), would be transferred to chamber C via chamber B and exhale from chamber C via an exhaust valve (not shown). An open circuit with fresh air taken from the environment would greatly simplify the setup and would obviate the need for the 3-way valve and reservoir 11.

In another exemplary embodiment, in which the working is confined in a closed circuit loop (as described in FIGS. 1-17) the whole engine (excluding an output shaft or a generator electrical output) would be encapsulated by a sealing envelop (not shown). This would be beneficial to retain a higher than atmospheric pressure at the engine closed circuit at rest. An external high pressure reservoir may be linked to the close circuit loop to compensate for pressure drops due to working fluid leaks.

The engine relative high compression ratio enables utilizing relative low volume heat exchangers, therefore, further reducing dead volume.

FIG. 18 illustrates a method 100 of operating an engine, in accordance with an embodiment. Method 100 includes compressing 102 working fluid in a first chamber, transferring 104 working fluid from the first chamber to a second chamber, decreasing 106 an internal volume of the second chamber while working fluid is within the internal volume, transferring 108 working fluid from the second chamber to a third chamber; and expanding 110 working fluid in the third chamber.

Decreasing the internal volume of the transfer chamber during transfer of the working fluid may advantageously increase the efficiency of the engine. For example, the decreasing volume may further increase the pressure of the working fluid prior to transfer, thus increasing the compression ratio of the engine. The engine may be an external split-cycle engine, and internal split-cycle engine, or any engine.

As used herein, the term "dead space" (or "dead volume") can be understood to refer to an area of the compression chamber A or the expansion chamber C or part of the TSCVM in an external heat engine or internal combustion engine, wherein the space (volume) holds compressed working fluid that does not participate in expansion. Such dead space can be a transfer valve or a connecting tube, or other structure that prevents fluid from being transferred and expanded. Other terms could be also used to describe such structures, such as dead volume or parasitic volume. Specific instances of dead space are discussed throughout this disclosure, but may not necessarily be limited to such instances.

As used herein, the term "fluid" can be understood to include both liquid and gaseous states.

As used herein, "crankshaft degrees" can be understood to refer to a portion of a crankshaft rotation, where a full rotation equals 360-degrees.

Although certain embodiments are described exclusively with respect to an external combustion engine or an internal combustion engine, it should be appreciated that the systems and methods apply equally to external combustion engines, internal combustion engines, and any other engine. In some embodiment, an ignition source inside the internal combustion engine could initiate expansion (for example, spark ignition; SI). In some embodiments, an ignition source is not used to initiate expansion in the internal combustion chamber and combustion may be initiated by compression (compression ignition; CI).

Description of an internal combustion engine—including phase-lag, combustion timing, opposite phase lag, compression piston leading, combustion at the spool and after coupling to the expansion cylinder, and multi-expansion cylinders to a single compression cylinder—are found in PCT Application No. PCT/US2014/047076, the content of which is incorporated herein by reference in its entirety and for all purposes.

Any variations in font in the diagrams or figures is accidental is not intended to signify a distinction or emphasis.

Although the present invention has been fully described in connection with embodiments thereof with reference to the accompanying drawings, it is to be noted that various changes and modifications will become apparent to those skilled in the art. Such changes and modifications are to be understood as being included within the scope of the present invention as defined by the appended claims. The various embodiments of the invention should be understood that they have been presented by way of example only, and not by way of limitation. Likewise, the various diagrams may depict an example architectural or other configuration for the invention, which is done to aid in understanding the features and functionality that can be included in the invention. The invention is not restricted to the illustrated example architectures or configurations, but can be implemented using a variety of alternative architectures and configurations. Additionally, although the invention is described above in terms of various exemplary embodiments and implementations, it should be understood that the various features and functionality described in one or more of the individual embodiments are not limited in their applicability to the particular embodiment with which they are described. They instead can, be applied, alone or in some combination, to one or more of the other embodiments of the invention, whether or not such embodiments are described, and whether or not such features are presented as being a part of a described embodiment. Thus the breadth and scope of the invention should not be limited by any of the above-described exemplary embodiments.

It will be appreciated that, for clarity purposes, the above description has described embodiments of the invention with reference to different functional units and processors. However, it will be apparent that any suitable distribution of functionality between different functional units, processors or domains may be used without detracting from the invention. For example, functionality illustrated to be performed by separate processors or controllers may be performed by the same processor or controller. Hence, references to specific functional units are only to be seen as references to suitable means for providing the described functionality, rather than indicative of a strict logical or physical structure or organization.

The particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

Terms and phrases used in this document, and variations thereof, unless otherwise expressly stated, should be construed as open ended as opposed to limiting. As examples of the foregoing; the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known", and terms of similar meaning, should not be construed as limiting the item described to a given time period, or to an item available as of a given time. But instead these terms should be read to encompass conventional, traditional, normal, or standard technologies that may be available, known now, or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. An engine comprising:

a compression chamber that intakes and compresses working fluid;

an expansion chamber that expands and exhausts the working fluid; and a transfer chamber that receives the working fluid from the compression chamber, moves reciprocally between and perpendicularly to the compression and expansion chambers, and transfers the working fluid to the expansion chamber; and a compression piston that compresses working fluid in the compression chamber and into the transfer chamber, wherein an internal volume of the transfer chamber decreases during the transfer of the working fluid to further compress the working fluid in the transfer chamber.

2. The engine of claim 1, further comprising an ignition source, inside the engine, that initiates expansion.

3. The engine of claim 1, further comprising a transfer port of the transfer chamber that alternatively fluidly couples to an outlet port of the compression chamber and to an inlet port of the expansion chamber.

4. The engine of claim 3, wherein the transfer port simultaneously couples the outlet port of the compression chamber with the transfer port of the transfer chamber and the inlet port of the expansion chamber with the transfer port of the transfer chamber during a portion of a cycle of the engine.

5. The engine of claim 1, wherein the transfer chamber comprises a transfer cylinder, a transfer cylinder extrusion, and a transfer cylinder housing, wherein the transfer cylinder is positioned within and moves relative to the transfer cylinder housing, and wherein the transfer cylinder extrusion is positioned within the transfer cylinder and does not move relative to the transfer cylinder housing.

6. The engine of claim 5, wherein the extrusion is parabolic.

7. The engine of claim 5, further comprising sealing rings between the transfer cylinder and transfer cylinder housing and between the transfer cylinder and transfer cylinder extrusion.

8. A method of operating an engine comprising:

compressing working fluid in a first chamber and into a second chamber;

transferring the working fluid from the first chamber to the second chamber;

moving the second chamber reciprocally between and perpendicularly to the first chamber and a third chambers;

decreasing an internal volume of the second chamber while the working fluid is within the internal volume to further compress working fluid in the second chamber;

transferring the working fluid from the second chamber to the third chamber; and expanding the working fluid in the third chamber.

9. The method of claim 8, further comprising transferring heat to the working fluid in the third chamber using a heat exchanger located partially outside the engine.

10. The method of claim 9, further comprising routing the working fluid from the third chamber to the first chamber.

11. The method of claim 10, further comprising cooling the working fluid as it is routed from the third chamber to the first chamber.

12. The method of claim 8, further comprising alternatively fluidly coupling the second chamber to an outlet port of the first chamber and to an inlet port of the third chamber through the movement of the second chamber between the first and third chambers.

13. The method of claim 12, simultaneously fluidly coupling the second chamber with the outlet port of the first chamber and the inlet port of the third chamber during a portion of a cycle of the engine.

14. The method of claim 13, wherein the second chamber comprises a cylinder, a cylinder extrusion, and a cylinder housing, wherein the cylinder is positioned within and moves relative to the cylinder housing, and wherein the cylinder extrusion is positioned within the cylinder and does not move relative to the cylinder housing.

15. The method of claim 14, wherein the extrusion is parabolic.

16. The method of claim 14, further comprising sealing rings between the cylinder and the cylinder housing.

17. An engine comprising:

a compression chamber that intakes and compresses working fluid;

an expansion chamber that expands and exhausts the working fluid;

a transfer chamber that receives the working fluid from the compression chamber, moves reciprocally between and perpendicularly to the compression and expansion chambers, and transfers the working fluid to the expansion chamber;

a compression piston that compresses working fluid in the compression chamber and into the transfer chamber, wherein an internal volume of the transfer chamber decreases during the transfer of the working fluid to further compress the working fluid in the transfer chamber; and a heat exchanger, for transfer of thermal energy from an external heat source to the working fluid.

18. The engine of claim 17, further comprising a conduit that routes the working fluid from the expansion chamber to the compression chamber.

19. The engine of claim 18, further comprising a cooling chamber in the conduit.

20. The engine of claim 18, further comprising a valve in the conduit that fluidly couples and decouples the compression and expansion chambers.

* * * * *